US009535375B2

(12) United States Patent
Tanaka et al.

(10) Patent No.: US 9,535,375 B2
(45) **Date of Patent: *Jan. 3, 2017**

(54) IMAGE FORMING APPARATUS WITH TRANSFER OUTPUT DEVICE OUTPUTTING SUPERIMPOSED BIAS AS TRANSFER BIAS

(71) Applicant: RICOH COMPANY, LTD., Tokyo (JP)

(72) Inventors: Shinya Tanaka, Kanagawa (JP); Hirokazu Ishii, Tokyo (JP); Yasunobu Shimizu, Kanagawa (JP); Keigo Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/013,627

(22) Filed: Feb. 2, 2016

(65) Prior Publication Data

US 2016/0154347 A1 Jun. 2, 2016

Related U.S. Application Data

(63) Continuation of application No. 13/893,594, filed on May 14, 2013, now Pat. No. 9,285,722.

(30) Foreign Application Priority Data

May 18, 2012 (JP) ..... 2012-114346
Mar. 27, 2013 (JP) ..... 2013-065722

(51) Int. Cl.
*G03G 15/16* (2006.01)

(52) U.S. Cl.
CPC ..... *G03G 15/1665* (2013.01); *G03G 15/1675* (2013.01)

(58) Field of Classification Search
CPC ..... G03G 15/1675; G03G 15/163; G03G 15/1635; G03G 15/1645
(Continued)

(56) References Cited

U.S. PATENT DOCUMENTS 5,515,146 A 5/1996 Harasawa et al.
5,631,725 A 5/1997 Harasawa et al.
(Continued)

FOREIGN PATENT DOCUMENTS

JP 9-146381 6/1997
JP 2001-255758 9/2001
(Continued)

OTHER PUBLICATIONS

U.S. Appl. No. 13/680,629, filed Nov. 19, 2012.
(Continued)

*Primary Examiner* — David Gray
*Assistant Examiner* — Andrew V Do
(74) *Attorney, Agent, or Firm* — Oblon, McClelland, Maier & Neustadt, L.L.P.

(57) ABSTRACT

An image forming apparatus includes a transfer bias output device and an information receiving device. The transfer bias output device outputs a transfer bias including a superimposed bias composed of an AC bias superimposed on a DC bias to form a transfer electric field in a transfer nip between an image bearing member bearing a toner image and a nip forming member, to transfer the toner image onto a recording medium in the transfer nip. A controller operatively connected to the information receiving device and the transfer bias output device causes the transfer bias output device to change a target output of a peak-to-peak voltage of the AC bias based on information received by the information receiving device that affects transfer of the toner image and to reduce a target output of the DC bias as the target output value of the peak-to-peak voltage of the AC bias increases.

14 Claims, 20 Drawing Sheets

(58) Field of Classification Search
USPC ..... 399/44, 66, 45
See application file for complete search history.

(56) References Cited

U.S. PATENT DOCUMENTS

| | | | |
|---|---|---|---|
| 5,812,919 | A | 9/1998 | Takano et al. |
| 5,822,667 | A | 10/1998 | Hayama et al. |
| 5,930,573 | A | 7/1999 | Miyamoto et al. |
| 6,188,862 | B1 | 2/2001 | Ishii |
| 6,282,386 | B1 | 8/2001 | Ishii |
| 2003/0035658 | A1 | 2/2003 | Ishii |
| 2005/0180767 | A1 | 8/2005 | Ishii et al. |
| 2007/0003333 | A1 | 1/2007 | Ishii |
| 2007/0014597 | A1 | 1/2007 | Ishii |
| 2007/0127941 | A1 | 6/2007 | Ishii et al. |
| 2010/0008687 | A1 | 1/2010 | Ishii |
| 2011/0229168 | A1 | 9/2011 | Shiraishi et al. |
| 2012/0008991 | A1 | 1/2012 | Shimizu |
| 2012/0045231 | A1 | 2/2012 | Ogino et al. |
| 2012/0045237 | A1 | 2/2012 | Aoki et al. |
| 2012/0045259 | A1 | 2/2012 | Nakamura et al. |
| 2012/0170951 | A1 | 7/2012 | Ishii |
| 2012/0219309 | A1 | 8/2012 | Yoshioka |
| 2012/0230715 | A1 | 9/2012 | Ogino et al. |
| 2012/0237234 | A1 | 9/2012 | Sugimoto et al. |
| 2012/0237271 | A1 | 9/2012 | Sengoku et al. |
| 2012/0243892 | A1 | 9/2012 | Nakamura et al. |
| 2012/0308250 | A1 | 12/2012 | Shimizu et al. |
| 2012/0315058 | A1 | 12/2012 | Shimizu et al. |
| 2012/0328314 | A1 | 12/2012 | Sugimoto et al. |
| 2012/0328315 | A1 | 12/2012 | Takeuchi et al. |
| 2012/0328320 | A1 | 12/2012 | Fujita et al. |
| 2012/0328321 | A1 | 12/2012 | Takeuchi et al. |
| 2013/0004190 | A1 | 1/2013 | Sengoku et al. |
| 2013/0011155 | A1 | 1/2013 | Ogiyama et al. |
| 2013/0016989 | A1 | 1/2013 | Fujita et al. |
| 2013/0064559 | A1 | 3/2013 | Nakamura et al. |
| 2013/0089363 | A1 | 4/2013 | Mimbu et al. |
| 2013/0094870 | A1 | 4/2013 | Shimizu et al. |

FOREIGN PATENT DOCUMENTS

| | | |
|---|---|---|
| JP | 2006-267486 | 10/2006 |
| JP | 2008-058585 | 3/2008 |

OTHER PUBLICATIONS

U.S. Appl. No. 13/666,474, filed Nov. 1, 2012.
U.S. Appl. No. 13/651,776, filed Oct. 15, 2012.
U.S. Appl. No. 13/693,304, filed Dec. 4, 2012.
U.S. Appl. No. 13/747,629, filed Jan. 23, 2013.
U.S. Appl. No. 13/739,482, filed Jan. 11, 2013.
U.S. Appl. No. 13/718,395, filed Dec. 18, 2012.
U.S. Appl. No. 13/690,408, filed Nov. 30, 2012.
U.S. Appl. No. 13/785,621, filed Mar. 5, 2013.
U.S. Appl. No. 13/700,500, filed Feb. 19, 2013.

FIG. 22

| Vpp | 4kV | 6kV | 8kV | 10kV | 12kV | |
|---|---|---|---|---|---|---|
| CONDITION 1 | −40 μA | −40 μA | −40 μA | −40 μA | −40 μA | Ioff |
| CONDITION 2 | −40 μA | −39 μA | −38 μA | −37 μA | −36 μA | |
| CONDITION 3 | −40 μA | −38 μA | −36 μA | −34 μA | −32 μA | |
| CONDITION 4 | −40 μA | −37 μA | −34 μA | −31 μA | −28 μA | |
| CONDITION 5 | −40 μA | −36 μA | −32 μA | −28 μA | −24 μA | |
| CONDITION 6 | −40 μA | −35 μA | −30 μA | −25 μA | −20 μA | |
| CONDITION 7 | −40 μA | −34 μA | −28 μA | −22 μA | −16 μA | |
| CONDITION 8 | −40 μA | −36 μA | −32 μA | −28 μA | −24 μA | |

FIG. 23

| Vpp | 4kV | | 6kV | | 8kV | | 10kV | | 12kV | |
|---|---|---|---|---|---|---|---|---|---|---|
| IMAGE EVALUATION | HT | SOLID | HT | SOLID | HT | SOLID | HT | SOLID | HT | SOLID |
| CONDITION 1 | GOOD | RECESS: POOR | RECESS: FAIR TONER VOIDS: FAIR | RECESS: POOR | TONER VOIDS: POOR | RECESS: FAIR | TONER VOIDS: POOR | TONER VOIDS: POOR | TONER VOIDS: POOR | TONER VOIDS: POOR |
| CONDITION 2 | GOOD | RECESS: POOR | GOOD | RECESS: FAIR | TONER VOIDS: FAIR | GOOD | TONER VOIDS: FAIR | TONER VOIDS: FAIR | TONER VOIDS: FAIR | TONER VOIDS: FAIR |
| CONDITION 3 | GOOD | RECESS: POOR | GOOD | RECESS: FAIR | GOOD | GOOD | TONER VOIDS: FAIR | GOOD | TONER VOIDS: FAIR | GOOD |
| CONDITION 4 | GOOD | RECESS: POOR | GOOD | RECESS: FAIR | GOOD | GOOD | GOOD | GOOD | TONER VOIDS: FAIR | GOOD |
| CONDITION 5 | GOOD | RECESS: POOR | GOOD | RECESS: FAIR | GOOD | GOOD | GOOD | GOOD | TONER VOIDS: FAIR | GOOD |
| CONDITION 6 | GOOD | RECESS: POOR | GOOD | RECESS: FAIR | GOOD | GOOD | GOOD | GOOD | TONER VOIDS: FAIR | SMOOTH: FAIR RECESS: FAIR |
| CONDITION 7 | GOOD | RECESS: POOR | GOOD | RECESS: FAIR | GOOD | GOOD | GOOD | SMOOTH: FAIR RECESS: FAIR | TONER VOIDS: FAIR | SMOOTH: FAIR RECESS: FAIR |
| CONDITION 8 | GOOD | RECESS: FAIR | GOOD | GOOD | GOOD | GOOD | GOOD | GOOD | GOOD | GOOD |

FIG. 24A

| Vpp | | 4kV | 6kV |
|---|---|---|---|
| CONDITION 1 | Ioff | ~~−40 μA~~ | ~~−40 μA~~ |
| | EVALUATION(HT) | ~~GOOD~~ | ~~RECESS:FAIR/ TONER VOIDS:FAIR~~ |
| | EVALUATION(SOLID) | ~~RECESS:POOR~~ | ~~RECESS:POOR~~ |
| CONDITION 2 | Ioff | ~~−40 μA~~ | −39 μA |
| | EVALUATION(HT) | ~~GOOD~~ | GOOD |
| | EVALUATION(SOLID) | ~~RECESS:POOR~~ | RECESS:FAIR |
| CONDITION 3 | Ioff | ~~−40 μA~~ | −38 μA |
| | EVALUATION(HT) | ~~GOOD~~ | GOOD |
| | EVALUATION(SOLID) | ~~RECESS:POOR~~ | RECESS:FAIR |
| CONDITION 4 | Ioff | ~~−40 μA~~ | −37 μA |
| | EVALUATION(HT) | ~~GOOD~~ | GOOD |
| | EVALUATION(SOLID) | ~~RECESS:POOR~~ | RECESS:FAIR |
| CONDITION 5 | Ioff | ~~−40 μA~~ | −36 μA |
| | EVALUATION(HT) | ~~GOOD~~ | GOOD |
| | EVALUATION(SOLID) | ~~RECESS:POOR~~ | RECESS:FAIR |
| CONDITION 6 | Ioff | ~~−40 μA~~ | −35 μA |
| | EVALUATION(HT) | ~~GOOD~~ | GOOD |
| | EVALUATION(SOLID) | ~~RECESS:POOR~~ | RECESS:FAIR |
| CONDITION 7 | Ioff | ~~−40 μA~~ | −34 μA |
| | EVALUATION(HT) | ~~GOOD~~ | GOOD |
| | EVALUATION(SOLID) | ~~RECESS:POOR~~ | RECESS:FAIR |
| CONDITION 8 | Ioff | −40 μA | −36 μA |
| | EVALUATION(HT) | GOOD | GOOD |
| | EVALUATION(SOLID) | RECESS:FAIR | GOOD |

FIG. 24B

NOTE: TEMPERATURE=10°C, HUMIDITY=15%

| 8kV | 10kV | 12kV |
|---|---|---|
| ~~−40 μA~~ | ~~−40 μA~~ | ~~−40 μA~~ |
| ~~TONER VOIDS:POOR~~ | ~~TONER VOIDS:POOR~~ | ~~TONER VOIDS:POOR~~ |
| ~~RECESS:FAIR~~ | ~~TONER VOIDS:POOR~~ | ~~TONER VOIDS:POOR~~ |
| −38 μA | −37 μA | −36 μA |
| TONER VOIDS:FAIR | TONER VOIDS:FAIR | TONER VOIDS:FAIR |
| GOOD | TONER VOIDS:FAIR | TONER VOIDS:FAIR |
| −36 μA | −34 μA | −32 μA |
| GOOD | TONER VOIDS:FAIR | TONER VOIDS:FAIR |
| GOOD | GOOD | GOOD |
| −34 μA | −31 μA | −28 μA |
| GOOD | GOOD | TONER VOIDS:FAIR |
| GOOD | GOOD | GOOD |
| −32 μA | −28 μA | −24 μA |
| GOOD | GOOD | TONER VOIDS:FAIR |
| GOOD | GOOD | GOOD |
| −30 μA | −25 μA | −20 μA |
| GOOD | GOOD | TONER VOIDS:FAIR |
| GOOD | GOOD | SMOOTH:FAIR/RECESS:FAIR |
| −28 μA | −22 μA | −16 μA |
| GOOD | GOOD | TONER VOIDS:FAIR |
| GOOD | SMOOTH:FAIR/RECESS:FAIR | SMOOTH:FAIR/RECESS:FAIR |
| −32 μA | −28 μA | −24 μA |
| GOOD | GOOD | GOOD |
| GOOD | GOOD | GOOD |

FIG. 25

| Vpp | | 4kV | 6kV | 8kV | 10kV | 12kV |
|---|---|---|---|---|---|---|
| CONDITION 8 | Ioff | −40 μA | −36 μA | −32 μA | −28 μA | −24 μA |
| | SMOOTH PORTION (HT) | GOOD | GOOD | GOOD | GOOD | GOOD |
| | SMOOTH PORTION(SOLID) | GOOD | GOOD | GOOD | GOOD | GOOD |
| CONDITION 9 | Ioff | −38 μA | −32 μA | −26 μA | ~~−20 μA~~ | ~~−14 μA~~ |
| | SMOOTH PORTION(HT) | GOOD | GOOD | FAIR | ~~FAIR~~ | ~~FAIR~~ |
| | SMOOTH PORTION(SOLID) | FAIR | FAIR | FAIR | ~~POOR~~ | ~~POOR~~ |
| CONDITION 10 | Ioff | ~~−28 μA~~ | ~~−22 μA~~ | ~~−18 μA~~ | ~~−16 μA~~ | ~~−13 μA~~ |
| | SMOOTH PORTION(HT) | ~~FAIR~~ | ~~FAIR~~ | ~~FAIR~~ | ~~FAIR~~ | ~~POOR~~ |
| | SMOOTH PORTION(SOLID) | ~~POOR~~ | ~~POOR~~ | ~~POOR~~ | ~~POOR~~ | ~~POOR~~ |
| CONDITION 11 | Ioff | ~~−18 μA~~ | ~~−12 μA~~ | ~~−12 μA~~ | ~~−12 μA~~ | ~~−12 μA~~ |
| | SMOOTH PORTION(HT) | ~~POOR~~ | ~~POOR~~ | ~~POOR~~ | ~~POOR~~ | ~~POOR~~ |
| | SMOOTH PORTION(SOLID) | ~~POOR~~ | ~~POOR~~ | ~~POOR~~ | ~~POOR~~ | ~~POOR~~ |

NOTE:
TEMPERATURE=10°C, HUMIDITY=15%

FIG. 26

| REAM WEIGHT (1000 SHEETS OF PAPER OF 788mm × 1091mm) | | 100kg | | 130kg | | 175kg | |
|---|---|---|---|---|---|---|---|
| CONTROL ITEMS | | Vpp | Ioff | Vpp | Ioff | Vpp | Ioff |
| CONDITION 12 | CONTROL VALUE | 6.2kV | −40 μA | 6.7kV | −40 μA | 7.5kV | −40 μA |
| | DENSITY (SMOOTH PORTION) | GOOD | | GOOD | | GOOD | |
| | DENSITY (RECESS PORTION) | GOOD | | GOOD | | GOOD | |
| | TONER VOIDS | GOOD | | FAIR | | POOR | |
| CONDITION 13 | CONTROL VALUE | 6.2kV | −40 μA | 6.7kV | −39 μA | 7.5kV | −38 μA |
| | DENSITY (SMOOTH PORTION) | GOOD | | GOOD | | GOOD | |
| | DENSITY (RECESS PORTION) | GOOD | | GOOD | | GOOD | |
| | TONER VOIDS | GOOD | | GOOD | | GOOD | |
| CONDITION 14 | CONTROL VALUE | 6.2kV | −40 μA | 6.7kV | −38 μA | 7.5kV | −36 μA |
| | DENSITY (SMOOTH PORTION) | GOOD | | GOOD | | GOOD | |
| | DENSITY (RECESS PORTION) | GOOD | | GOOD | | GOOD | |
| | TONER VOIDS | GOOD | | GOOD | | GOOD | |
| CONDITION 15 | CONTROL VALUE | 6.2kV | −38 μA | 6.7kV | −36 μA | 7.5kV | −34 μA |
| | DENSITY (SMOOTH PORTION) | FAIR | | FAIR | | FAIR | |
| CONDITION 16 | CONTROL VALUE | 6.2kV | −36 μA | 6.7kV | −32 μA | 7.5kV | −28 μA |
| | DENSITY (SMOOTH PORTION) | POOR | | POOR | | POOR | |

NOTE 1: TEMPERATURE = 10°C, HUMIDITY = 15%
NOTE 2: A SOLID IMAGE WAS USED TO EVALUATE THE IMAGE DENSITY AT THE SMOOTH PORTION AND THE RECESS.
NOTE 3: AN HT IMAGE WAS USED TO EVALUATE TONER VOIDS.

FIG. 27

| ENVIRONMENT | | 10°C15% | | 23°C50% | | 17°C80% | | 32°C80% | |
|---|---|---|---|---|---|---|---|---|---|
| CONTROL ITEMS | | Vpp | Ioff | Vpp | Ioff | Vpp | Ioff | Vpp | Ioff |
| CONDITION 17 | CONTROL VALUE | 9.2kV | −38 μA | 7.5kV | −38 μA | 6.9kV | −38 μA | 6.1kV | −38 μA |
| | DENSITY (SMOOTH PORTION) | GOOD | | GOOD | | GOOD | | GOOD | |
| | DENSITY (RECESS PORTION) | GOOD | | GOOD | | GOOD | | GOOD | |
| | TONER VOIDS | FAIR | | GOOD | | FAIR | | POOR | |
| CONDITION 18 | CONTROL VALUE | 9.2kV | −37 μA | 7.5kV | −38 μA | 6.9kV | −39 μA | 6.1kV | −40 μA |
| | DENSITY (SMOOTH PORTION) | GOOD | | GOOD | | GOOD | | GOOD | |
| | DENSITY (RECESS PORTION) | GOOD | | GOOD | | GOOD | | GOOD | |
| | TONER VOIDS | GOOD | | GOOD | | GOOD | | FAIR | |
| CONDITION 19 | CONTROL VALUE | 9.2kV | −36 μA | 7.5kV | −38 μA | 6.9kV | −40 μA | 6.1kV | −42 μA |
| | DENSITY (SMOOTH PORTION) | GOOD | | GOOD | | GOOD | | GOOD | |
| | DENSITY (RECESS PORTION) | GOOD | | GOOD | | GOOD | | GOOD | |
| | TONER VOIDS | GOOD | | GOOD | | GOOD | | GOOD | |
| CONDITION 20 | CONTROL VALUE | 9.2kV | −34 μA | 7.5kV | −34 μA | 6.9kV | −34 μA | 6.1kV | −34 μA |
| | DENSITY (SMOOTH PORTION) | FAIR | | FAIR | | FAIR | | FAIR | |
| CONDITION 21 | CONTROL VALUE | 9.2kV | −30 μA | 7.5kV | −30 μA | 6.9kV | −30 μA | 6.1kV | −30 μA |
| | DENSITY (SMOOTH PORTION) | POOR | | POOR | | POOR | | POOR | |

NOTE 1: A SOLID IMAGE WAS USED TO EVALUATE THE IMAGE DENSITY AT THE SMOOTH PORTION AND THE RECESS.
NOTE 2: AN HT IMAGE WAS USED TO EVALUATE TONER VOIDS.

FIG. 28

| IMAGE AREA RATIO | | 5% | | 25% | | 50% | | 75% | |
|---|---|---|---|---|---|---|---|---|---|
| CONTROL ITEMS | | Vpp | Voff | Vpp | Voff | Vpp | Voff | Vpp | Voff |
| CONDITION 22 | CONTROL VALUE | 6.0kV | −2.0kV | 6.0kV | −2.0kV | 6.0kV | −2.0kV | 6.0kV | −2.0kV |
| | DENSITY (SMOOTH PORTION) | GOOD | | GOOD | | GOOD | | FAIR | |
| | DENSITY (RECESS PORTION) | GOOD | | FAIR | | POOR | | POOR | |
| | TONER VOIDS | GOOD | | GOOD | | GOOD | | GOOD | |
| CONDITION 23 | CONTROL VALUE | 6.0kV | −2.0kV | 6.6kV | −2.0kV | 7.2kV | −2.0kV | 7.8kV | −2.0kV |
| | DENSITY (SMOOTH PORTION) | GOOD | | GOOD | | GOOD | | GOOD | |
| | DENSITY (RECESS PORTION) | GOOD | | GOOD | | GOOD | | GOOD | |
| | TONER VOIDS | GOOD | | FAIR | | POOR | | POOR | |
| CONDITION 24 | CONTROL VALUE | 6.0kV | −2.0kV | 6.9kV | −1.9kV | 7.2kV | −1.8kV | 7.8kV | −1.7kV |
| | DENSITY (SMOOTH PORTION) | GOOD | | GOOD | | GOOD | | GOOD | |
| | DENSITY (RECESS PORTION) | GOOD | | GOOD | | GOOD | | GOOD | |
| | TONER VOIDS | GOOD | | GOOD | | GOOD | | FAIR | |
| CONDITION 25 | CONTROL VALUE | 6.0kV | −2.0kV | 6.9kV | −1.8kV | 7.2kV | −1.6kV | 7.8kV | −1.4kV |
| | DENSITY (SMOOTH PORTION) | GOOD | | GOOD | | GOOD | | GOOD | |
| | DENSITY (RECESS PORTION) | GOOD | | GOOD | | GOOD | | GOOD | |
| | TONER VOIDS | GOOD | | GOOD | | GOOD | | GOOD | |

IMAGE FORMING APPARATUS WITH TRANSFER OUTPUT DEVICE OUTPUTTING SUPERIMPOSED BIAS AS TRANSFER BIAS

CROSS-REFERENCE TO RELATED APPLICATIONS

This application is a continuation application of U.S. application Ser. No. 13/893,594, filed May 14, 2013, which is in turn based upon and claims the benefit of priority from Japanese Patent Application Nos. 2012-114346, filed on May 18, 2012, and 2013-065722, filed on Mar. 27, 2013, both in the Japan Patent Office, which are hereby incorporated herein by reference in their entirety.

BACKGROUND

Technical Field

Exemplary aspects of the present disclosure generally relate to an image forming apparatus, such as a copier, a facsimile machine, a printer, or a multi-functional system including a combination thereof, and more particularly to, an image forming apparatus including a transfer bias output device that outputs a superimposed bias as a transfer bias.

Description of the Related Art

There are known image forming apparatuses equipped with a transfer bias output device that outputs a superimposed bias as a transfer bias in which an alternating current bias and a direct current bias are superimposed, to transfer a toner image onto a recording medium. In the image forming apparatuses of this kind, toner images formed on photosensitive drums through the electrophotographic process are transferred onto a belt-type intermediate transfer member (hereinafter, intermediate transfer belt) and then onto a recording medium at a secondary transfer nip at which the intermediate transfer belt and a secondary transfer roller meet and press against each other.

In this configuration, when using a recording medium having a coarse surface such as Japanese paper and embossed paper, a pattern of light and dark according to surface conditions of the recording medium appears easily in an output image. That is, toner does not transfer well to such embossed surfaces, in particular, recessed portions of the surface. Thus, an image density at the recessed portions is lower than the image density at projecting portions or smooth portions. This inadequate transfer of the toner appears as a pattern of light and dark patches in the resulting output image.

In view of the above, in one approach, a secondary bias composed of a superimposed bias including an alternating current (AC) bias and a direct current (DC) bias is applied to the secondary transfer roller. Using the superimposed bias as a secondary transfer bias enhances transfer of toner to the recessed portions of the surface of the recording medium, thereby preventing the pattern of light and dark patches.

However, without proper control of a peak-to-peak voltage of an AC component of the secondary bias in accordance with transfer conditions that affect transfer of toner such as temperature, humidity, a thickness of the recording medium, a size (depth) of the recessed portions of the recording medium surface, and an amount of toner adhered to the surface of the photosensitive drum per unit area, toner is not transferred well to the recessed portions of the recording medium, resulting in inadequate image density at the recessed portions of the recording medium and hence producing the pattern of light and dark patches.

Furthermore, in a low-temperature, low-humidity environment, a desirable image density is difficult to obtain in the recessed portions of the recording medium in a configuration in which an AC bias is either under constant voltage control or constant current control so as to achieve a target output value for a peak-to-peak voltage of an AC component, and the target output value is changed depending on the transfer conditions such as temperature while supplying a DC component under constant current control or constant voltage control. When a transfer peak value of the secondary transfer bias is too high in a low-temperature, low-humidity environment, electric discharge occurs in the recessed portions of the recording medium in the secondary transfer nip, causing reverse charging of toner particles. Such reverse charging causes toner voids or missing of toner in an image at the recessed portions on the surface of the recording medium, which appears as white dots in an output image.

In view of the above, there is demand for an image forming apparatus capable of preventing an undesirable pattern of light and dark associated with surface conditions of a recording medium.

SUMMARY

In view of the foregoing, in an aspect of this disclosure, there is provided an improved image forming apparatus including an image bearing member, a nip forming member, a transfer bias output device, an information receiving device, and a controller. The image bearing member bears a toner image on a surface thereof. The nip forming member contacts the surface of the image bearing member to form a transfer nip therebetween. The transfer bias output device outputs a transfer bias to form a transfer electric field including an alternating electric field in the transfer nip to transfer the toner image from the image bearing member onto a recording medium interposed in the transfer nip. The transfer bias includes a superimposed bias in which an alternating current (AC) bias is superimposed on a direct current (DC) bias. The information receiving device receives information that affects transfer of the toner image from the image bearing member to the recording medium in the transfer nip. The controller is operatively connected to the information receiving device and the transfer bias output device and causes the transfer bias output device to change a target output value of a peak-to-peak voltage of the AC bias based on the information received by the information receiving device and reduce a target output value of the DC bias as the target output value of the peak-to-peak voltage of the AC bias increases.

According to another aspect, an image forming apparatus includes an image bearing member, a nip forming member, a transfer bias output device, an information receiving device, and a controller. The image bearing member bears a toner image on a surface thereof. The nip forming member contacts the surface of the image bearing member to form a transfer nip therebetween. The transfer bias output device outputs a transfer bias to form a transfer electric field including an alternating electric field in the transfer nip to transfer the toner image from the image bearing member onto a recording medium interposed in the transfer nip. The transfer bias includes a superimposed bias in which an alternating current (AC) bias is superimposed on a direct current (DC) bias. The information receiving device receives information including at least one of temperature, humidity, a thickness of the recording medium delivered to the transfer nip, a surface condition of the recording medium including a depth of a recessed portion thereof, and an amount of toner adhered to the surface of the image bearing member per unit area. The controller is operatively connected to the information receiving device and the transfer bias output device and causes the transfer bias output device to change a target output value of a peak-to-peak voltage of the AC bias based on the information received by the information receiving device and reduce a target output value of the DC bias as the target output value of the peak-to-peak voltage of the AC bias increases.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 22 is a table showing different conditions of a peak-to-peak voltage Vpp and an offset current Ioff in Experiment 3;

FIG. 23 is a table showing results of image evaluations in Experiment 3;

FIGS. 24A and 24B are tables showing integrated results shown in FIGS. 22 and 23;

FIG. 25 is a table showing results of additional print tests;

FIG. 26 is a table showing results of image evaluations in Experiment 4;

FIG. 27 is a table showing results of image evaluations in Experiment 5; and FIG. 28 is a table showing results of image evaluations in Experiment 9.

DETAILED DESCRIPTION

Figure 1:
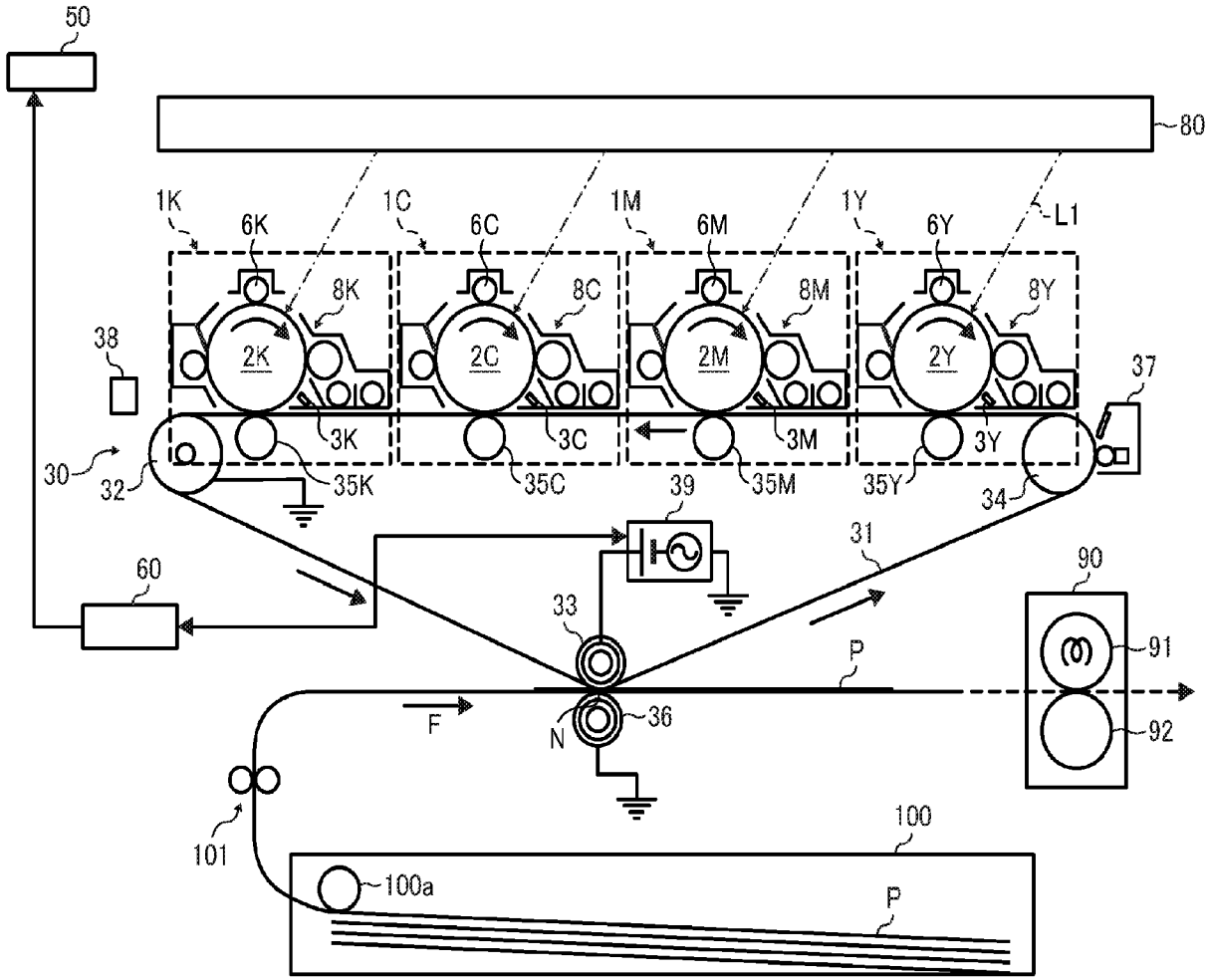
FIG. 1 is a schematic diagram illustrating a printer as an example of an image forming apparatus, according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating a printer as an example of the image forming apparatus. As illustrated in FIG. 1, the image forming apparatus includes four image forming units 1Y, 1M, 1C, and 1K for forming toner images, one for each of the colors yellow, magenta, cyan, and black, respectively, a transfer unit 30, an optical writing unit 80, a fixing device 90, a sheet tray 100, and a pair of registration rollers 101. The order of image forming units 1Y, 1M, 1C, and 1K is not limited to this order.

It is to be noted that the suffixes Y, M, C, and K denote colors yellow, magenta, cyan, and black, respectively. To simplify the description, these suffixes Y, M, C, and K indicating colors are omitted herein, unless otherwise specified.

The optical writing unit 80 is disposed substantially above the image forming units 1Y, 1M, 1C, and 1K. The sheet tray 100 is disposed at the bottom of the image forming apparatus. The fixing device 90 is disposed downstream from the transfer unit 30 in the direction of transport of the recording medium indicated by a hollow arrow.

The image forming units 1Y, 1M, 1C, and 1K all have the same configuration as all the others, differing only in the color of toner employed. Thus, a description is provided of the image forming unit 1K for forming a toner image of black as a representative example of the image forming units 1 with reference to FIG. 2. The image forming units 1Y, 1M, 1C, and 1K are replaced upon reaching their product life cycles.

Figure 2:
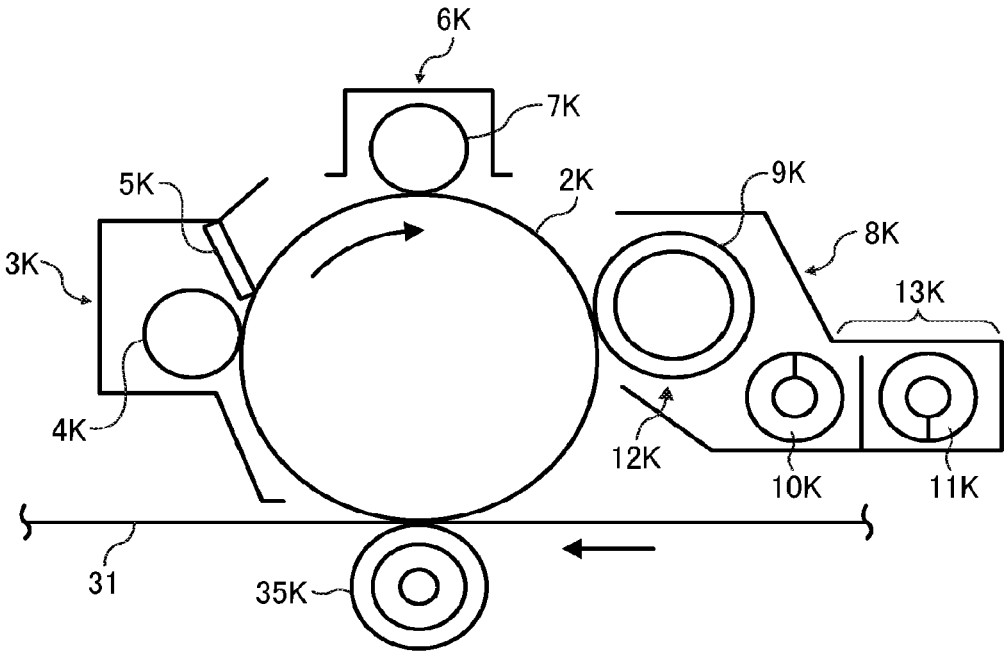
FIG. 2 is a schematic diagram illustrating an image forming unit for the color black as a representative example of image forming units employed in the image forming apparatus of FIG. 1.

With reference to FIG. 2, a description is provided of the image forming unit 1K as an example of the image forming units. FIG. 2 is a schematic diagram illustrating the image forming unit 1K. The image forming unit 1K includes a photosensitive drum 2K serving as a latent image bearing member. The photosensitive drum 2K is surrounded by various pieces of imaging equipment, such as a charging device 6K, a developing device 8K, a drum cleaning device 3K, and a charge remover. The image forming units 1Y, 1M, 1C, and 1K are held by a common holder so that they are detachably attachable relative to the image forming apparatus and hence replaceable at the same time. Similar to the image forming unit 1K, the image forming units 1Y, 1M, and 1C include photosensitive drums 2Y, 2M, and 2C, respectively. The photosensitive drums 2Y, 2M, and 2C are surrounded by charging devices 6Y, 6M, and 6C, developing devices 8Y, 8M, and 8C, drum cleaning devices 3Y, 3M, and 3C, and charge removers.

The photosensitive drum 2K comprises a drum-shaped base on which an organic photosensitive layer is disposed, with the external diameter of approximately 60 mm. The photosensitive drum 2K is rotated in a clockwise direction by a driving device. The charging device 6K includes a charging roller 7K supplied with a charging bias. The charging roller 7K contacts or approaches the photosensitive drum 2K to generate an electrical discharge therebetween, thereby charging uniformly the surface of the photosensitive drum 2K. According to the present illustrative embodiment, the photosensitive drum 2K is uniformly charged with a negative polarity which is the same polarity as the normal charge on toner. As the charging bias, an alternating current (AC) voltage superimposed on a direct current (DC) voltage is employed. The charging roller 7K comprises a metal cored bar covered with a conductive elastic layer made of a conductive elastic material. According to the present embodiment, the photosensitive drum 2K is charged by the charging roller 7K contacting the photosensitive drum 2K or disposed near the photosensitive drum 2K. Alternatively, a corona charger may be employed.

The uniformly charged surface of the photosensitive drum 2K is scanned by a light beam projected from the optical writing unit 80, thereby forming an electrostatic latent image for the color black on the surface of the photosensitive drum 2K. The electrostatic latent image for the color black on the photosensitive drum 2K is developed with black toner by the developing device 8K. Accordingly, a visible image, also known as a toner image of black, is formed. As will be described later, the toner image is transferred primarily onto an intermediate transfer belt 31.

The drum cleaner 3K removes residual toner remaining on the photosensitive drum 2K after the primary transfer process, that is, after the photosensitive drum 2K passes through a primary transfer nip between the intermediate transfer belt 31 and the photosensitive drum 2K. The drum cleaner 3K includes a brush roller 4K and a cleaning blade 5K. The cleaning blade 5K is cantilevered, that is, one end of the cleaning blade 5K is fixed to the housing of the drum cleaner 3K, and its free end contacts the surface of the photosensitive drum 2K. The brush roller 4K rotates and brushes off the residual toner from the surface of the photosensitive drum 2K while the cleaning blade 5K removes the residual toner by scraping. It is to be noted that the cantilevered end of the cleaning blade 5K is positioned downstream from its free end contacting the photosensitive drum 2K in the direction of rotation of the photosensitive drum 2K so that the free end of the cleaning blade 5K faces or becomes counter to the direction of rotation.

The charge remover removes residual charge remaining on the photosensitive drum 2K after the surface thereof is cleaned by the drum cleaner 3K in preparation for the subsequent imaging cycle. The surface of the photosensitive drum 2K is initialized.

The developing device 8K includes a developing section 12K and a developer conveyer 13K. The developing section 12K includes a developing roller 9K inside thereof. The developer conveyer 13K mixes a developing agent for the color black and transports the developing agent. The developer conveyer 13K includes a first chamber equipped with a first screw 10K and a second chamber equipped with a second screw 11K. The first screw 10K and the second screw 11K are each constituted of a rotatable shaft and helical fighting wrapped around the circumferential surface of the shaft. Each end of the shaft of the first screw 10K and the second screw 11K in the axial direction is rotatably held by a shaft bearing.

The first chamber with the first screw 10K and the second chamber with the second screw 11K are separated by a wall, but each end of the wall in the direction of the screw shaft has a connecting hole through which the first chamber and the second chamber are connected. The first screw 10K mixes the developing agent by rotating the helical fighting and carries the developing agent from the distal end to the proximal end of the screw in the direction perpendicular to the surface of the recording medium while rotating. The first screw 10K is disposed parallel to and facing the developing roller 9K. Hence, the developing agent is delivered along the axial (shaft) direction of the developing roller 9K. The first screw 10K supplies the developing agent to the surface of the developing roller 9K along the direction of the shaft line of the developing roller 9K.

The developing agent transported near the proximal end of the first screw 10K in FIG. 2 passes through the connecting hole in the wall near the proximal side and enters the second chamber. Subsequently, the developing agent is carried by the helical flighting of the second screw 11K. As the second screw 11K rotates, the developing agent is delivered from the proximal end to the distal end in the drawing while being mixed in the direction of rotation.

In the second chamber, a toner density detector for detecting the density of toner in the developing agent is disposed substantially at the bottom of a casing of the chamber. As the toner density detector, a magnetic permeability detector is employed. There is a correlation between the toner density and the magnetic permeability of the developing agent consisting of toner and a magnetic carrier. Therefore, the magnetic permeability detector can detect the density of the toner.

Although not illustrated, the image forming apparatus includes toner supply devices to supply independently toner of yellow, magenta, cyan, and black to the second chamber of the respective developing devices 8. A controller 60 of the image forming apparatus includes a Random Access Memory (RAM) to store a target output voltage Vtref for output voltages provided by the toner density detectors for yellow, magenta, cyan, and black. If the difference between the output voltages provided by the toner density detectors for yellow, magenta, cyan, and black, and Vtref for each color exceeds a predetermined value, the toner supply devices are driven for a predetermined time period corresponding to the difference to supply toner. Accordingly, the respective color of toner is supplied to the second chamber of the developing device 8K.

The developing roller 9K in the developing section 12K faces the first screw 10K as well as the photosensitive drum 2K through an opening formed in the casing of the developing device 8K. The developing roller 9K comprises a cylindrical developing sleeve made of a non-magnetic pipe which is rotated, and a magnetic roller disposed inside the developing sleeve. The magnetic roller is fixed so as not to rotate together with the developing sleeve. The developing agent supplied from the first screw 10K is carried on the surface of the developing sleeve due to the magnetic force of the magnetic roller. As the developing sleeve rotates, the developing agent is transported to a developing area facing the photosensitive drum 2K.

The developing sleeve is supplied with a developing bias having the same polarity as toner. The developing bias is greater than the bias of the electrostatic latent image on the photosensitive drum 2K, but is less than the charging potential of the uniformly charged photosensitive drum 2K. With this configuration, a developing potential that causes the toner on the developing sleeve to move electrostatically to the electrostatic latent image on the photosensitive drum 2K acts between the developing sleeve and the electrostatic latent image on the photosensitive drum 2K. A non-developing potential acts between the developing sleeve and the non-image formation areas of the photosensitive drum 2K, causing the toner on the developing sleeve to move to the sleeve surface. Due to the developing potential and the non-developing potential, the toner on the developing sleeve moves selectively to the electrostatic latent image formed on the photosensitive drum 2K, thereby forming a visible image, known as a toner image, here, a black toner image.

Similar to the image forming unit 1K, toner images of yellow, magenta, and cyan are formed on the photosensitive drums 2Y, 2M, and 2C of the image forming units 1Y, 1M, and 1C, respectively.

The optical writing unit 80 for writing a latent image on the photosensitive drums 2 is disposed above the image forming units 1Y, 1M, 1C, and 1K. Based on image information received from an external device such as a personal computer (PC), the optical writing unit 80 illuminates the photosensitive drums 2Y, 2M, 2C, and 2K with a light beam projected from a laser diode of the optical writing unit 80. Accordingly, the electrostatic latent images of yellow, magenta, cyan, and black are formed on the photosensitive drums 2Y, 2M, 2C, and 2K, respectively. More specifically, the potential of the portion of the charged surface of the photosensitive drum 2 illuminated with the light beam is attenuated. The potential of the illuminated portion of the photosensitive drum 2 is less than the potential of the other area, that is, the background portion (non-image portion), thereby forming the electrostatic latent image on the photosensitive drum 2.

The optical writing unit 80 includes a polygon mirror, a plurality of optical lenses, and mirrors. The light beam projected from the laser diode serving as a light source is deflected in a main scanning direction by the polygon mirror rotated by a polygon motor. The deflected light, then, strikes the optical lenses and mirrors, thereby scanning the photosensitive drums 2. Alternatively, the optical writing unit 80 may employ a light source using an LED array including a plurality of LEDs that projects light.

Referring back to FIG. 1, a description is provided of the transfer unit 30. The transfer unit 30 is disposed below the image forming units 1Y, 1M, 1C, and 1K. The transfer unit 30 includes the intermediate transfer belt 31 serving as an image bearing member formed into an endless loop and rotated in the counterclockwise direction. The transfer unit also includes a drive roller 32, a secondary-transfer back surface roller 33, a cleaning backup roller 34, an nip forming roller 36, a belt cleaning device 37, an electric potential detector 38, four primary transfer rollers 35Y, 35M, 35C, and so forth.

The intermediate transfer belt 31 is entrained around and stretched taut between the drive roller 32, the secondary-transfer back surface roller 33, the cleaning backup roller 34, and the primary transfer rollers 35Y, 35M, 35C, and 35K (which may be collectively referred to as the primary transfer rollers 35, unless otherwise specified.) The drive roller 32 is rotated in the counterclockwise direction by a motor or the like, and rotation of the drive roller 32 enables the intermediate transfer belt 31 to rotate in the same direction.

The intermediate transfer belt 31 has following characteristics. The intermediate transfer belt 31 has a thickness in a range of from 20 μm to 200 μm, preferably, approximately 60 μm. The volume resistivity thereof is in a range of from approximately 6.0 [Log Ω·cm] to approximately 13 [Log Ω·cm], preferably, in a range of from approximately 7.5 [Log Ω·cm] to approximately 12.5 [Log Ω·cm]. The volume resistivity is measured with an applied voltage of 100V by a resistivity meter, HIRESTA UPMCPHT 450 with the FIRS probe manufactured by Mitsubishi Chemical Corporation. The volume resistivity is obtained after 10 seconds.

The surface resistivity of the intermediate transfer belt 31 is in a range of from approximately 9.0 [Log Ω/sq] to approximately 13.0 [Log Ω/sq], preferably, approximately 10.0 [Log Ω/sq] to approximately 12.0 [Log Ω/sq]. The surface resistivity is measured with an applied voltage of 500V by HIRESTA UPMCPHT 450 manufactured by Mitsubishi Chemical Corporation with an FIRS probe. The surface resistivity is obtained after 10 seconds.

The intermediate transfer belt 31 is interposed between the photosensitive drums 2Y, 2M, 2C, and 2K, and the primary transfer rollers 35Y, 35M, 35C, and 35K. Accordingly, primary transfer nips are formed between the outer peripheral surface or the image bearing surface of the intermediate transfer belt 31 and the photosensitive drums 2Y, 2M, 2C, and 2K that contact the intermediate transfer belt 31. The primary transfer rollers 35Y, 35M, 35C, and 35K are supplied with a primary transfer bias by a transfer bias power source, thereby generating a transfer electric field between the toner images on the photosensitive drums 2Y, 2M, 2C, and 2K, and the respective primary transfer rollers 35Y, 35M, 35C, and 35K.

The toner image of yellow formed on the photosensitive drum 2Y enters the primary transfer nip as the photosensitive drum 2Y rotates. Subsequently, the toner image of yellow is primarily transferred from the photosensitive drum 2Y to the intermediate transfer belt 31 by the transfer electrical field and the nip pressure applied thereto. As the intermediate transfer belt 31 on which the toner image of yellow is transferred passes through the primary transfer nips of magenta, cyan, and black, accordingly, the toner images on the photosensitive drums 2M, 2C, and 2K are superimposed one atop the other on top of the toner image of yellow which has been transferred on the intermediate transfer belt 31, thereby forming a composite toner image on the intermediate transfer belt 31 in the primary transfer process.

Each of the primary transfer rollers 35Y, 35M, 35C, and 35K is an elastic roller including a metal cored bar on which a conductive sponge layer is fixated. The shaft center of each of the shafts of the primary transfer rollers 35Y, 35M, 35C, and 35K is approximately 2.5 mm off from the shaft center of the shafts of the photosensitive drums 2Y, 2M, 2C, and 2K toward the downstream side in the direction of movement of the intermediate transfer belt 31. The primary transfer bias under constant current control is applied to the primary transfer rollers 35Y, 35M, 35C, and 35K described above.

According to the present illustrative embodiment, a roller-type primary transfer device is used as the primary transfer rollers 35Y, 35M, 35C, and 35K. Alternatively, a transfer charger and a brush-type transfer device may be employed as a primary transfer device.

The nip forming roller 36 of the transfer unit 30 is disposed outside the loop formed by the intermediate transfer belt 31, opposite the secondary-transfer back surface roller 33. The intermediate transfer belt 31 is interposed between the secondary-transfer back surface roller 33 and the nip forming roller 36, thereby forming a secondary transfer nip N between the outer peripheral surface of intermediate transfer belt 31 and the nip forming roller 36. The nip forming roller 36 is grounded. The secondary-transfer back surface roller 33 is supplied with a secondary transfer bias from a secondary transfer bias power source 39 serving as a transfer bias output device. With this configuration, a secondary transfer electric field is formed between the secondary-transfer back surface roller 33 and the nip forming roller 36 so that the toner of negative polarity is transferred electrostatically from the secondary-transfer back surface roller side to the nip forming roller side.

As illustrated in FIG. 1, the sheet tray 100 storing a stack of recording media sheets P is disposed below the transfer unit 30. The sheet tray 100 is equipped with a sheet feed roller 100*a* to contact a top sheet of the stack of recording media sheets P. As the sheet feed roller 100*a* is rotated at a predetermined speed, the sheet feed roller 100*a* picks up the top sheet and feeds it to a sheet passage in the image forming apparatus. Substantially at the end of the sheet passage, a pair of registration rollers 101 is disposed. The pair of the registration rollers 101 stops rotating temporarily as soon as the recording medium P is interposed therebetween. The pair of registration rollers 101 starts to rotate again to feed the recording medium P to the secondary transfer nip N in appropriate timing such that the recording medium P is aligned with the composite toner image formed on the intermediate transfer belt 31 in the secondary transfer nip N. In the secondary transfer nip N, the recording medium P tightly contacts the composite toner image on the intermediate transfer belt 31, and the composite toner image is transferred from the intermediate transfer belt 31 to the recording medium P by the secondary transfer electric field and the nip pressure applied thereto. The recording medium P on which the composite color toner image is formed passes through the secondary transfer nip N and separates from the nip forming roller 36 and the intermediate transfer belt 31 by self-stripping.

The secondary-transfer back surface roller 33 is formed of a metal cored bar on which a conductive elastic layer is disposed. The secondary-transfer back surface roller 33 has the following characteristics. The external diameter of the secondary-transfer back surface roller 33 is in a range from approximately 20 mm to 24 mm. The diameter of the metal cored bar is approximately 16 mm. The resistance R of the conductive elastic layer disposed on the metal cored bar is in a range of from 1E6Ω to 2E7Ω. The resistance R is measured using the same method as the primary transfer roller 35 described above. The resistance of the secondary-transfer back surface roller 33 is in a range of from approximately 6.0 Log Ω to 12.0 Log Ω, preferably, 4.0 Log Ω. It is to be noted that a stainless roller without the conductive elastic layer may be used as the secondary-transfer back surface roller 33.

The resistance of the secondary-transfer back surface roller 33 is measured as follows. That is, a weight of 5 N is applied to both ends of the roller in the longitudinal direction, and a voltage of 1 kV is supplied to the roller. The resistance thereof is measured multiple times while the roller is rotated once in one minute.

The nip forming roller 36 comprises a metal cored bar on which a conductive NBR rubber layer is disposed. The outer diameter of the nip forming roller 36 is approximately 24 mm. The diameter of the metal cored bar is approximately 14 mm. The resistance R of the conductive NBR rubber layer is equal to or less than 1E6Ω. The resistance R is measured using the same method as the primary transfer roller 35 described above. The resistance of the nip forming roller 36 is in a range of from approximately 6.0 Log Ω to approximately 8.0 Log Ω, preferably in a range of from approximately 7.0 Log Ω to 8.0 Log Ω. The resistance is measured using the same method as the primary transfer roller described above.

The secondary transfer bias power source 39 outputs a secondary transfer bias to form a transfer electric field in the secondary transfer nip N. According the illustrative embodiment of the present disclosure, a superimposed bias, in which an AC voltage is superimposed on a DC voltage, is output as the secondary transfer bias. An output terminal of the secondary transfer bias power source 39 is connected to the metal cored bar of the secondary-transfer back surface roller 33. The potential of the metal cored bar of the secondary-transfer back surface roller 33 has a similar or the same value as the output voltage output from the secondary transfer bias power source 39. Furthermore, the metal cored bar of the nip forming roller 36 is grounded.

The secondary transfer bias power source 39 outputs a DC voltage having the same polarity as the charge polarity of the toner as the DC voltage of the secondary transfer bias. The secondary transfer bias output from the secondary transfer bias power source 39 is applied to the metal cored bar of the secondary-transfer back surface roller 33. Between the secondary-transfer back surface roller 33 and the nip forming roller 36, the toner on the intermediate transfer belt 31 is transferred electrostatically from the secondary-transfer back surface roller side to the nip forming roller side. Accordingly, the toner is secondarily transferred onto the recording medium P.

Figure 3:
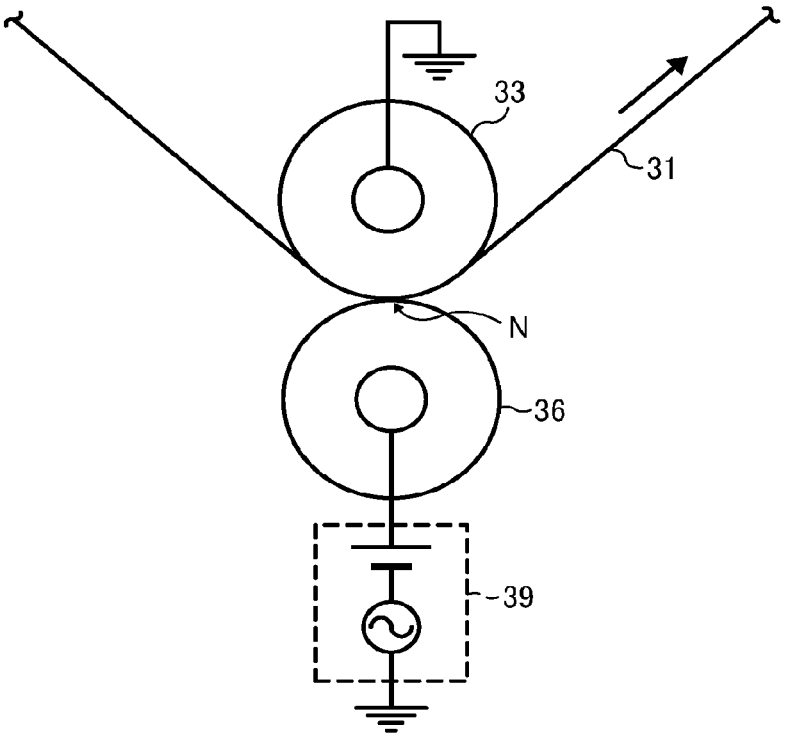
FIG. 3 is an enlarged schematic diagram illustrating a second example of the configuration of a secondary transfer bias application.

Application of the secondary transfer bias is not limited to the configuration illustrated in FIG. 1. For example, as illustrated in FIG. 3, the secondary-transfer back surface roller 33 is grounded while the secondary transfer bias output from the secondary transfer bias power source 39 is applied to the metal cored bar of the nip forming roller 36. In this case, as the DC voltage of the secondary transfer bias, the DC voltage having the polarity opposite the charge polarity of toner is output. FIG. 3 shows an example of application of the secondary transfer bias in which the charge polarity of toner is negative and the DC voltage of the secondary transfer bias is positive which is opposite the charge polarity of toner.

Figure 4:
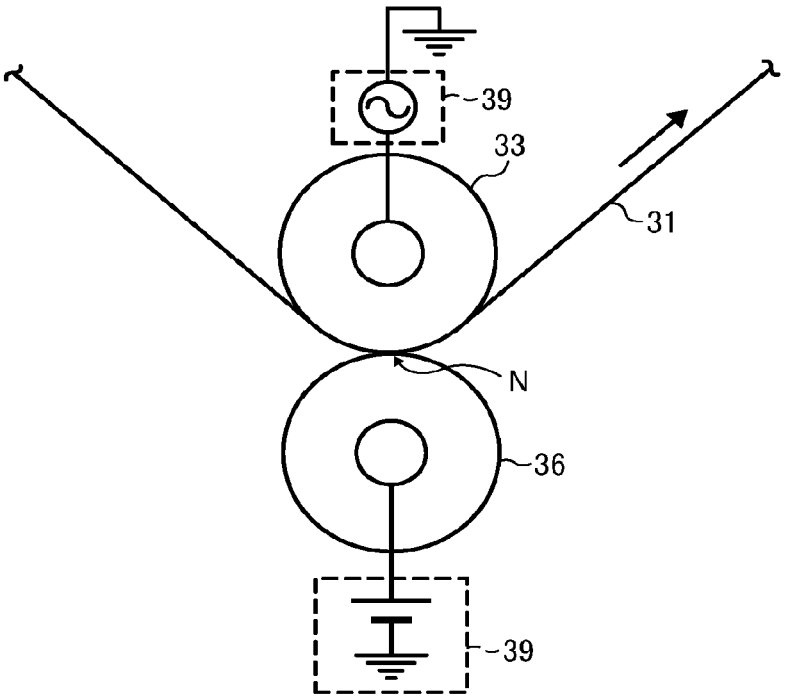
FIG. 4 is an enlarged schematic diagram illustrating a third example of the configuration of the secondary transfer bias application.

Alternatively, as illustrated in FIG. 4, the AC voltage output from the secondary transfer bias power source 39 is supplied to the metal cored bar of the secondary-transfer back surface roller 33 while the DC voltage output from the secondary transfer bias power source 39 is applied to the metal cored bar of the nip forming roller 36. In this example, similar to the example shown in FIG. 3, the DC voltage having the polarity opposite the charge polarity of toner is output from the secondary transfer bias power source 39.

Figure 5:
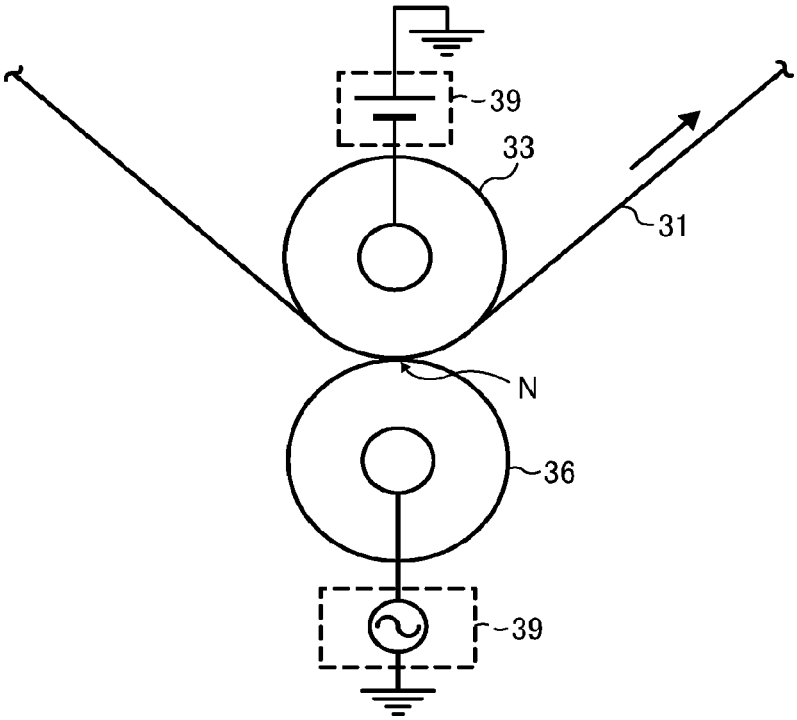
FIG. 5 is an enlarged schematic diagram illustrating a fourth example of the configuration of the secondary transfer bias application.

Alternatively, as illustrated in FIG. 5, the AC voltage output from the secondary transfer bias power source 39 is supplied to the metal cored bar of the nip forming roller 36, while the DC voltage output from the secondary transfer bias power source 39 is supplied to the metal cored bar of the secondary-transfer back surface roller 33. In this example, the DC voltage having the same polarity as the charge polarity of toner is output from the secondary transfer bias power source 39.

Figure 6:
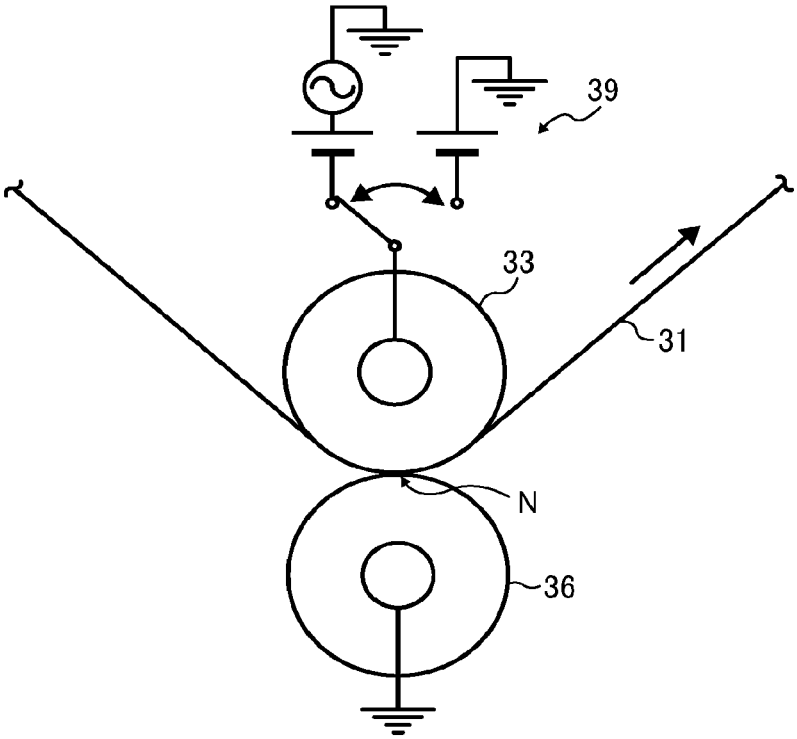
FIG. 6 is an enlarged schematic diagram illustrating a fifth example of the configuration of the secondary transfer bias application.

Alternatively, as illustrated in FIG. 6, the secondary transfer bias power source 39 may include two electrical circuits: one that outputs a superimposed voltage in which the DC voltage is superimposed on the AC voltage, and another that outputs only the DC voltage. In other words, one of the two circuits is selected by a switching circuit to selectively supply one of the superimposed voltage and the DC voltage to the secondary-transfer back surface roller 33. In this example, both electrical circuits output the DC voltage having the same polarity as the charge polarity of the toner.

Figure 7:
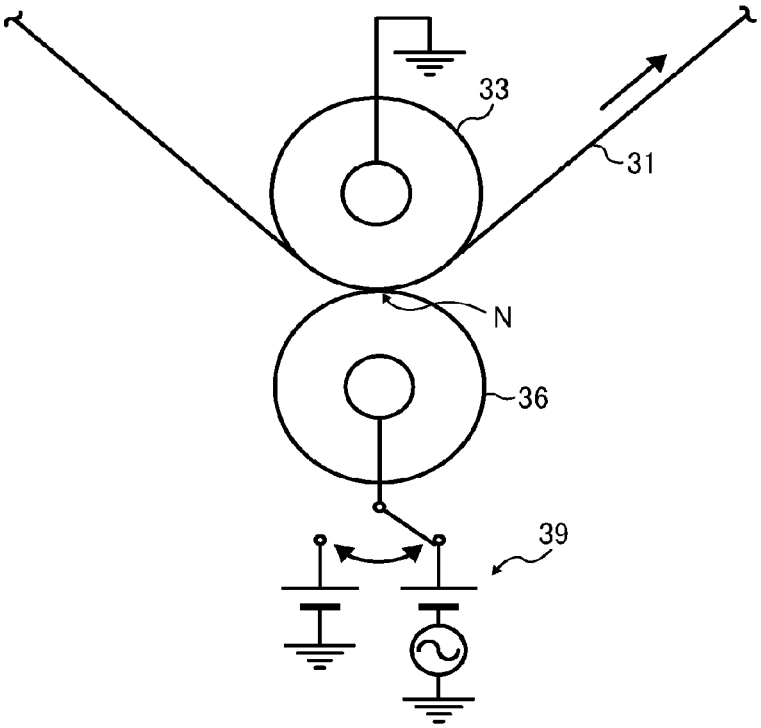
FIG. 7 is an enlarged schematic diagram illustrating a sixth example of the configuration of the secondary transfer bias application.

Alternatively, as illustrated in FIG. 7, one of the two circuits described above is selected by the switching circuit to supply one of the superimposed voltage and the DC voltage to the nip forming roller 36. In this example, both electrical circuits output the DC voltage having the opposite polarity of the charge polarity of the toner.

As described above, the secondary transfer bias can be applied in various ways. However, for a normal sheet of paper such as the one having a relatively smooth surface or a low surface roughness, an image density is consistent even when the secondary transfer bias consisting only of the DC voltage is applied as a secondary transfer bias. In view of the above, according to the present illustrative embodiment, the secondary transfer power source 39 includes a first mode in which the secondary transfer power source 39 outputs only the DC voltage and a second mode in which the secondary transfer power source 39 outputs both the DC voltage and the AC voltage. The first mode and the second mode are switchable. In order to change the modes, for example, as illustrated in FIGS. 8 and 9, a relay switch is employed to turn on and off the output of the DC voltage and the AC voltage.

Figure 8:
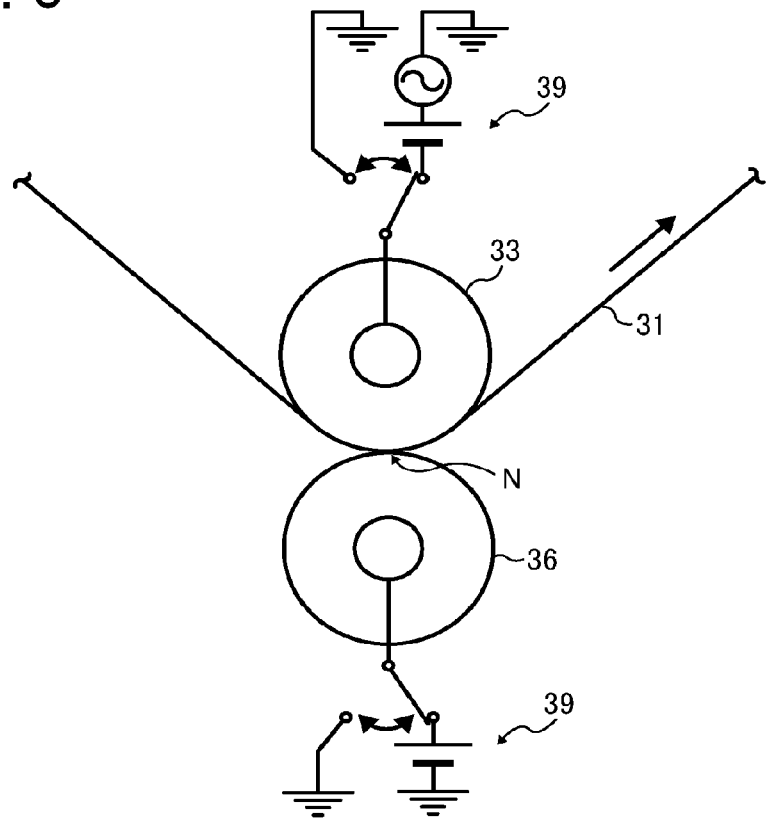
FIG. 8 is an enlarged schematic diagram illustrating a seventh example of the configuration of the secondary transfer bias application.

In the example shown in FIG. 8, the secondary transfer bias power source 39 includes a superimposed-voltage electrical circuit and a DC-voltage electrical circuit. The superimposed-voltage electrical circuit outputs a superimposed voltage to be supplied to the secondary-transfer back surface roller 33. The DC-voltage electrical circuit outputs a DC voltage to be supplied to the nip forming roller 36. The relay switch connected to the secondary-transfer back surface roller 33 establishes and breaks electrical continuity between the secondary-transfer back surface roller 33 and the superimposed-voltage electrical circuit by switching the connection. The relay switch connected to the nip forming roller 36 establishes and breaks electrical continuity between the nip forming roller 36 and the DC-voltage electrical circuit by switching the connection.

It is to be noted that the relay switch connected to the secondary-transfer back surface roller 33 and the relay switch connected to the nip forming roller 36 operate together. More specifically, when the relay switch connected to the secondary-transfer back surface roller 33 establishes electrical continuity between the secondary-transfer back surface roller 33 and the superimposed-voltage electrical circuit, the relay switch connected to the nip forming roller 36 connects the nip forming roller 36 to earth. The DC component of the superimposed voltage output from the superimposed-voltage electrical circuit has the same polarity as the charge polarity of toner. When the secondary-transfer back surface roller 33 is connected to earth by the relay switch, the relay switch connected to the nip forming roller 36 establishes electrical continuity between the nip forming roller 36 and the DC-voltage electrical circuit. The DC voltage output from the DC-voltage electrical circuit has the polarity opposite the charge polarity of toner.

Figure 9:
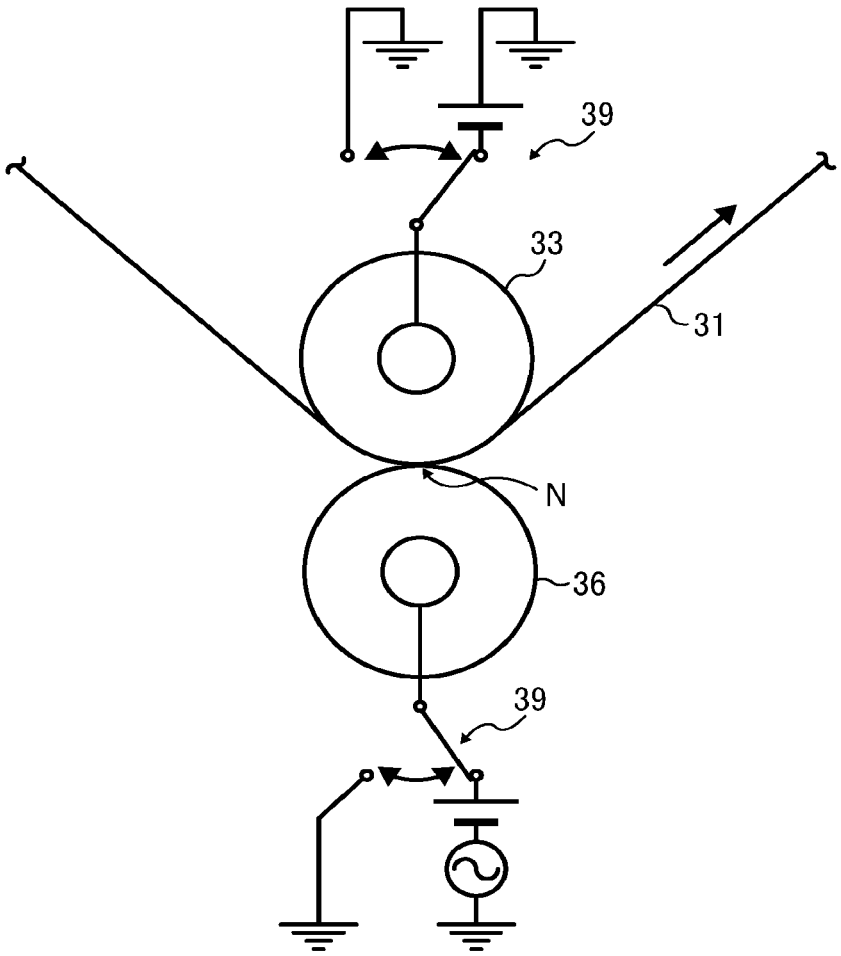
FIG. 9 is an enlarged schematic diagram illustrating an eighth example of the configuration of the secondary transfer bias application.

In the example shown in FIG. 9, the secondary transfer bias power source 39 includes the DC-voltage electrical circuit and the superimposed-voltage electrical circuit. The DC-voltage electrical circuit outputs a DC voltage to be supplied to the secondary-transfer back surface roller 33. The superimposed-voltage electrical circuit outputs a superimposed voltage to be supplied to the nip forming roller 36. The relay switch connected to the secondary-transfer back surface roller 33 establishes and breaks electrical continuity between the secondary-transfer back surface roller 33 and the DC-voltage electrical circuit by switching the connection. The relay switch connected to the nip forming roller 36 establishes and breaks electrical continuity between the nip forming roller 36 and the superimposed-voltage electrical circuit by switching the connection.

It is to be noted that the relay switch connected to the secondary-transfer back surface roller 33 and the relay switch connected to the nip forming roller 36 operate together. More specifically, when the relay switch connected to the secondary-transfer back surface roller 33 establishes electrical continuity between the secondary-transfer back surface roller 33 and the DC-voltage electrical circuit, the relay switch connected to the nip forming roller 36 connects the nip forming roller 36 to earth.

The DC voltage output from the DC-voltage electrical circuit has the same polarity as the charge polarity of toner. When the secondary-transfer back surface roller 33 is connected to earth by the relay switch, the relay switch connected to the nip forming roller 36 establishes electrical continuity between the nip forming roller 36 and the superimposed-voltage electrical circuit. The DC component of the superimposed voltage output from the superimposed-voltage electrical circuit has the same polarity as the charge polarity of toner.

When using a normal sheet of paper as a recording medium P, such as paper having a relatively smooth surface, a pattern of dark and light patches according to the surface conditions is less likely to appear on the recording medium. In this case, the secondary transfer bias power source 39 carries out the first mode to supply the secondary transfer bias consisting only of the DC voltage. By contrast, when using a recording medium such as pulp paper having a rough surface, the secondary transfer bias power source 39 carries out the second mode to apply the secondary transfer bias consisting of both the DC voltage and the AC voltage.

After the intermediate transfer belt 31 passes through the secondary transfer nip N, residual toner not having been transferred onto the recording medium P remains on the intermediate transfer belt 31. The residual toner is removed from the intermediate transfer belt 31 by the belt cleaning device 37 which contacts the outer peripheral surface or the image bearing surface of the intermediate transfer belt 31. The cleaning backup roller 34 disposed inside the loop formed by the intermediate transfer belt 31 supports the cleaning operation by the belt cleaning device 37.

On the right hand side of the secondary transfer nip N between the secondary-transfer back surface roller 33 and the intermediate transfer belt 31 in FIG. 1, the fixing device 90 is provided. The fixing device 90 includes a fixing roller 91 and a pressing roller 92. The fixing roller 91 includes a heat source such as a halogen lamp inside thereof. While rotating, the pressing roller 92 pressingly contacts the fixing roller 91, thereby forming a heated area called a fixing nip therebetween. The recording medium P bearing an unfixed toner image on the surface thereof is delivered to the fixing device 90 and interposed between the fixing roller 91 and the pressing roller 92 in the fixing device 90. Under heat and pressure, the toner adhered to the toner image is softened and fixed to the recording medium P in the fixing nip. After the fixing process, the recording medium P is discharged outside the image forming apparatus from the fixing device 90 via the sheet passage.

In the case of monochrome imaging, a support plate supporting the primary transfer rollers 35Y, 35M, and 35C of the transfer unit 30 is moved to separate the primary transfer rollers 35Y, 35M, and 35C from the photosensitive drums 2Y, 2M, and 2C. Accordingly, the outer peripheral surface of the intermediate transfer belt 31, that is, the image bearing surface, is separated from the photosensitive drums 2Y, 2M, and 2C so that the intermediate transfer belt 31 contacts only the photosensitive drum 2K. In this state, the image forming unit 1K is activated to form a toner image of the color black on the photosensitive drum 2K.

Figure 10:
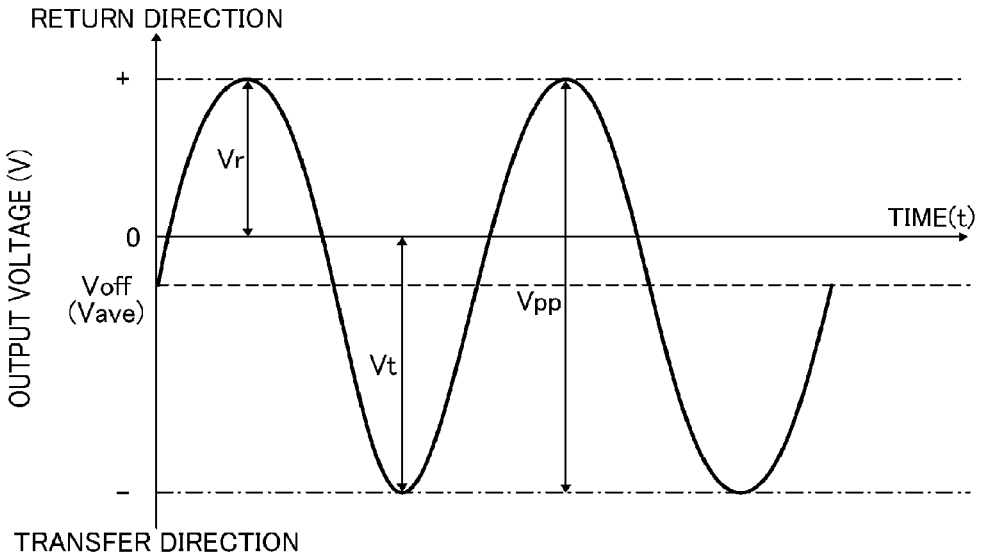
FIG. 10 shows a waveform of a superimposed bias serving as a secondary bias output from a secondary transfer bias power source employed in the image forming apparatus.

With reference to FIG. 10, a description is provided of the secondary transfer bias. FIG. 10 is a waveform chart showing a waveform of the secondary bias consisting of a superimposed voltage output from the secondary transfer bias power source 39. The secondary transfer bias is supplied to the metal cored bar of the secondary-transfer back surface roller 33. The nip forming roller 36 is grounded as illustrated in FIGS. 1 and 8. When the secondary transfer bias is supplied to the metal cored bar of secondary-transfer back surface roller 33, a potential difference is generated between the metal cored bar of the secondary-transfer back surface roller 33 and the metal cored bar of the nip forming roller 36.

In FIG. 10, an offset voltage Voff is a value of a DC component of the superimposed voltage. A peak-to-peak voltage Vpp is a value of an AC component of the peak-to-peak voltage of the superimposed voltage. The superimposed voltage has a sinusoidal waveform, and the duty cycle of the AC component is 50%. Hence, the time-averaged value of the superimposed voltage coincides with the value of the offset voltage Voff. In FIG. 10, the offset voltage Voff has negative polarity which is the same polarity as the charge polarity of toner. According to the present illustrative embodiment, when the polarity of the offset voltage Voff of the secondary transfer bias applied to the secondary-transfer back surface roller 33 is negative, toner particles having negative polarity are repelled by the secondary-transfer back surface roller 33 relatively toward the nip forming roller side. However, the toner is not always repelled by the secondary-transfer back surface roller 33, but is drawn to the secondary-transfer back surface roller 33. Because the time-averaged potential has negative polarity, the toner particles are repelled by the secondary-transfer back surface roller 33 toward the nip forming roller side.

In FIG. 10, a return peak potential Vr represents a positive peak value having the polarity opposite that of the toner in the secondary transfer bias. A transfer peak value Vt represents a negative peak value having the same polarity as that of the toner in the secondary transfer bias.

Next, a description is provided of a transfer experiment performed by the present inventors to study principles of a superimposed bias as a secondary transfer bias that results in a sufficient image density at recessed portions of a surface of a recording medium.

In the experiment, a bias that forms an alternating electric field in the secondary transfer nip N was used as a secondary transfer bias. A special observation equipment was manufactured to observe behavior of toner to find out how to achieve a sufficient image density at the recessed portions of the surface of the recording medium.

Figure 11:
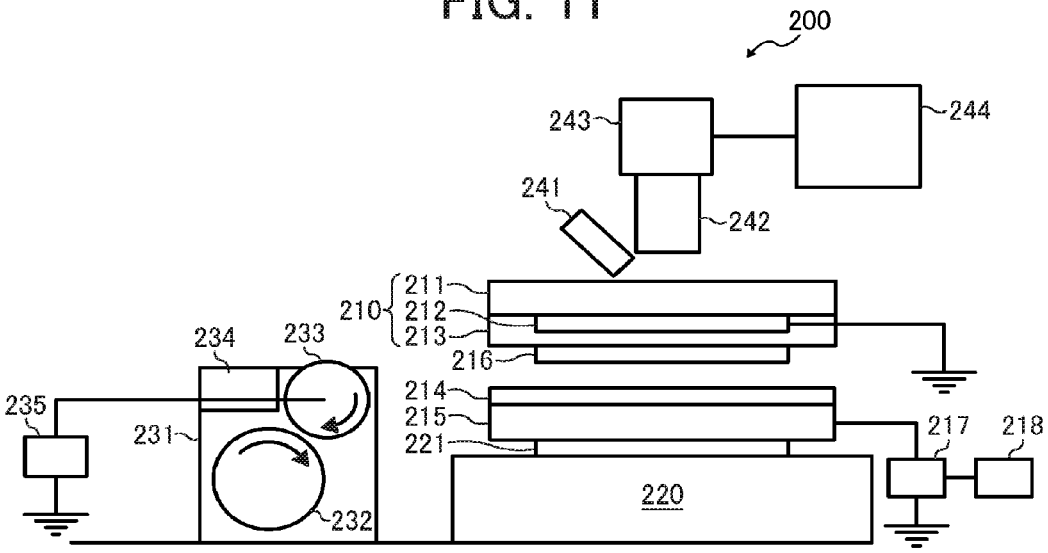
FIG. 11 is a schematic diagram illustrating an observation equipment for observation of behavior of toner in a secondary transfer nip.

FIG. 11 shows an observation equipment 200. The observation equipment includes a transparent substrate 210, a developing device 231, a Z stage 220, a light source 241, a microscope 242, a high-speed camera 243, a personal computer (PC) 244, and so forth. The transparent substrate 210 includes a glass plate 211, a transparent electrode 212 made of Indium Tin Oxide (ITO) and disposed on a lower surface of the glass plate 211, and a transparent insulating layer 213 made of a transparent material covering the transparent electrode 212. The transparent substrate 210 is supported at a predetermined height position by a substrate support. The substrate support is allowed to move in the vertical and horizontal directions in the drawing by a moving assembly. In the illustrated example shown in FIG. 11, the transparent substrate 210 is located above the Z stage 220 including a metal plate 215 placed thereon. The transparent substrate 210 is capable of moving to a position directly above the developing device 231 disposed lateral to the Z stage 220, in accordance with the movement of the substrate support. The transparent electrode 212 of the transparent substrate 210 is connected to a grounded electrode fixed to the substrate support.

The developing device 231 has a configuration similar to that of the developing device 8 shown in FIG. 1 according to the illustrative embodiment, and includes a screw 232, a development roll 233, a doctor blade 234, and so forth. The development roll 233 is driven to rotate with a development bias applied thereto by a power source 235.

By moving the substrate support, the transparent substrate 210 is moved to a position directly above the developing device 231 at a predetermined speed and disposed opposite the development roll 233 with a predetermined gap therebetween. Then, toner on the development roll 233 is transferred to the transparent electrode 212 of the transparent substrate 210. Thereby, a toner layer 216 having a predetermined thickness is formed on the transparent electrode 212 of the transparent substrate 210. The toner adhesion amount per unit area in the toner layer 216 is adjustable by the toner density in the developing agent, the toner charge amount, the development bias value, the gap between the transparent substrate 210 and the developing roll 233, the moving speed of the transparent substrate 210, the rotation speed of the developing roller 233, and so forth.

The transparent substrate 210 on which the toner layer 216 is formed is translated to a position opposite a recording medium 214 adhered to the planar metal plate 215 by a conductive adhesive. The metal plate 215 is placed on the substrate 221, which is provided with a load sensor and placed on the Z stage 220. Further, the metal plate 215 is connected to the voltage amplifier 217. The waveform generator 218 provides the voltage amplifier 217 with a transfer bias including a DC voltage and an AC voltage. The transfer bias is amplified by the voltage amplifier 217 and applied to the metal plate 215. If the Z stage 220 is driven and elevates the metal plate 215, the recording medium 214 starts coming into contact with the toner layer 216. If the metal plate 215 is further elevated, the pressure applied to the toner layer 216 increases. The elevation of the metal plate 215 is stopped when the output from the load sensor reaches a predetermined value. With the pressure maintained at the predetermined value, a transfer bias is applied to the metal plate 215, and the behavior of the toner is observed. After the observation, the Z stage 220 is driven to lower the metal plate 215, thereby separating the recording medium 214 from the transparent substrate 210. Accordingly, the toner layer 216 is transferred onto the recording medium 214.

The behavior of the toner was examined using the microscope 242 and the high-speed camera 243 disposed above the transparent substrate 210. The transparent substrate 210 is formed of the layers of the glass plate 211, the transparent electrode 212, and the transparent insulating layer 213, which are all made of transparent material. It is therefore possible to observe, from above and through the transparent substrate 210, the behavior of the toner located under the transparent substrate 210.

In the experiment, a microscope using a zoom lens VH-Z75 manufactured by Keyence Corporation was used as the microscope 242. Further, a camera FASTCAM-MAX 120KC manufactured by Photron Limited was used as the high-speed camera 243 controlled by the personal computer 244. The microscope 242 and the high-speed camera 243 are supported by a camera support. The camera support adjusts the focus of the microscope 242.

The behavior of the toner was photographed as follows. That is, the position at which the behavior of the toner to be observed was illuminated with light by the light source 241, and the focus of the microscope 242 was adjusted. Then, a transfer bias was applied to the metal plate 215 to move the toner in the toner layer 216 adhering to the lower surface of the transparent substrate 210 toward the recording medium 214. The behavior of the toner in this process was photographed by the high-speed camera 243.

The structure of the transfer nip in which toner is transferred onto a recording medium in the observation experiment equipment illustrated in FIG. 11 is different from the image forming apparatus of the illustrative embodiment. Therefore, the transfer electric field acting on the toner is different therebetween, even if the applied transfer bias is the same.

To find appropriate observation conditions, transfer bias conditions allowing the observation experiment equipment 200 to attain favorable density reproducibility on recessed portions of a surface of a recording medium were investigated. As the recording medium 214, a sheet of FC Japanese paper SAZANAMI manufactured by NBS Ricoh Company, Ltd. was used. As the toner, yellow (Y) toner having an average toner particle diameter of approximately 6.8 μm mixed with a relatively small amount of black (K) toner was used. The observation experiment equipment 200 is configured to apply the transfer bias to a rear surface of the recording sheet 214. In the observation experiment equipment 200, the polarity of the transfer bias capable of transferring the toner onto the recording sheet 214 is opposite the polarity of the transfer bias employed in the image forming apparatus according to the illustrative embodiment (that is, positive polarity).

As the AC component of the transfer bias including a superimposed voltage, an AC component having a sinusoidal waveform was employed. The frequency f of the AC component was set at 1000 Hz, and the DC voltage (which corresponds to the offset voltage Voff in the illustrative embodiment, and the time-averaged value has the same value) was set at 200 V, and the peak-to-peak voltage Vpp was set at 1000 V. The toner layer 216 was transferred onto the recording medium 214 with a toner adhesion amount in a range of from approximately 0.4 $mg/cm^2$ to approximately 0.5 $mg/cm^2$. As a result, a sufficient image density was successfully obtained on the recessed portions of the surface of the SAZANAMI paper sheet.

Under the above-described conditions, the behavior of the toner was photographed with the microscope 242 focused on the toner layer 216 on the transparent substrate 210, and the following phenomenon was observed. That is, the toner particles in the toner layer 216 moved back and forth between the transparent substrate 210 and the recording sheet 214 due to an alternating electric field generated by the AC component of the transfer bias. With an increase in the number of the back-and-forth movements, the amount of toner particles moving back and forth was increased.

Figure 12:
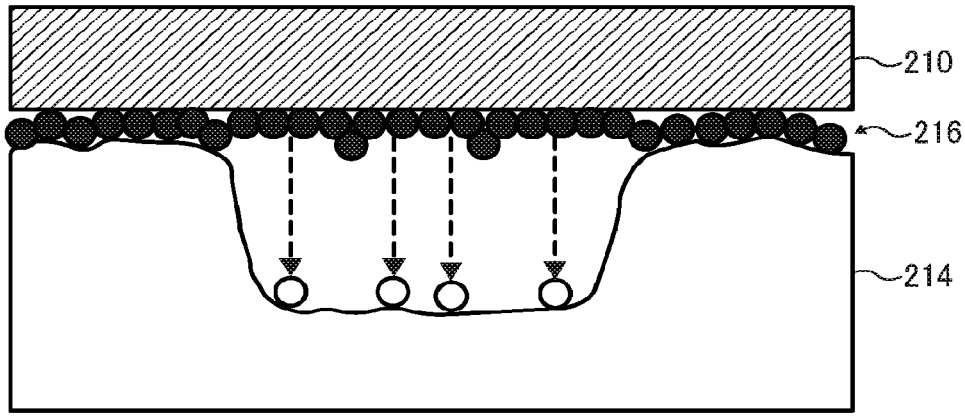
FIG. 12 is an enlarged schematic diagram illustrating behavior of toner in the secondary transfer nip at the beginning of transfer.
Figure 13:
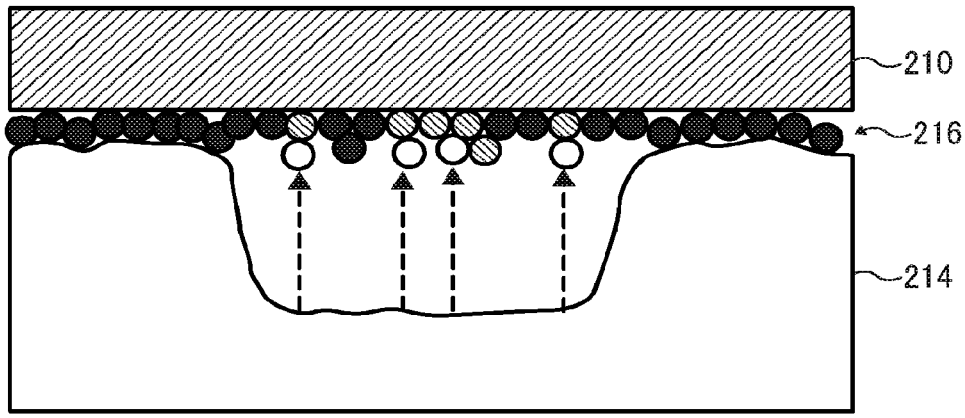
FIG. 13 is an enlarged schematic diagram illustrating behavior of the toner in the secondary transfer nip in the middle phase of transfer.

More specifically, in the transfer nip, there was one back-and-forth movement of toner particles in every cycle 1/f of the AC component of the transfer bias (the secondary transfer bias in the image forming apparatus of the illustrative embodiment) due to a single action of the alternating electric field. In the first cycle, only toner particles present on a surface of the toner layer 216 separated from the toner layer 216, as illustrated in FIG. 12. The toner particles then entered the recessed portions of the recording sheet 214, and then returned to the toner layer 216. In this process, the returning toner particles collided with other toner particles remaining in the toner layer 216, thereby reducing the adhesion of the other toner particles to the toner layer 216 or to the transparent substrate 210. In the next cycle, therefore, a larger amount of toner particles than in the previous cycle separated from the toner layer 216, as illustrated in FIG. 13. The toner particles then entered the recessed portions of the recording medium 214, and then returned to the toner layer 216, as illustrated in FIG. 13. In this process, the returning toner particles collided with other toner particles remaining in the toner layer 216, thereby reducing the adhesion of the other toner particles to the toner layer 216 or to the transparent substrate 210.

Figure 14:
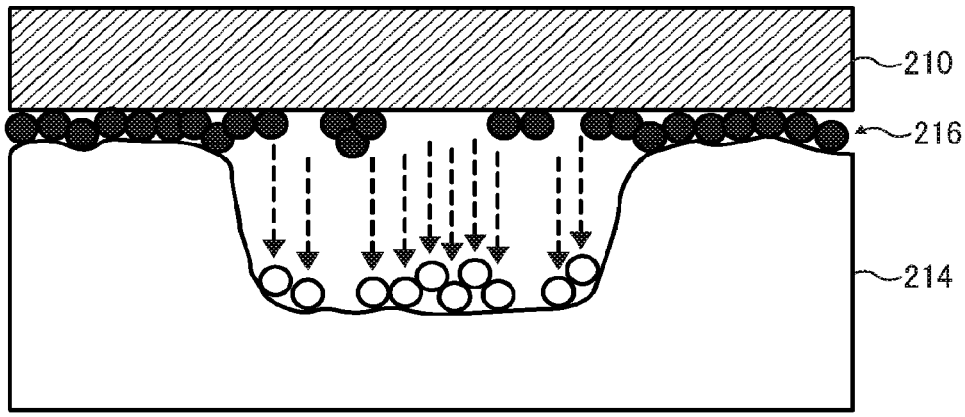
FIG. 14 is an enlarged schematic diagram illustrating behavior of toner in the secondary transfer nip in the last phase of transfer.

In the next cycle, therefore, a larger amount of toner particles than in the previous cycle separated from the toner layer 216, as illustrated in FIG. 14. As described above, the number of toner particles moving back and forth was gradually increased every time the toner particles moved back and forth. After the lapse of a nip passage time, for example, a time corresponding to the actual nip passage time in the observation experiment equipment 200, a sufficient amount of toner had been transferred to the recessed portions of the recording medium 214.

Further, the behavior of the toner was photographed under conditions with a DC voltage of approximately 200 V and the peak-to-peak voltage Vpp of the alternating current voltage of approximately 800 V, and the following phenomenon was observed. That is, some of the toner particles in the toner layer 216 present on the surface thereof separated from the toner layer 216 in the first cycle, and entered the recessed portions of the recording medium 214. Subsequently, however, the toner particles in the recessed portions remained therein, without returning to the toner layer 216. In the next cycle, a very small number of toner particles newly separated from the toner layer 216 and entered the recessed portions of the recording medium 214. After the lapse of the nip passage time, therefore, only a relatively small amount of toner particles had been transferred to the recessed portions of the recording medium 214.

The present inventors conducted further experiments and found the following. That is, a return peak value Vr capable of causing the toner particles having separated from the toner layer 216 and entered the recessed portions of the recording medium 214 to return to the toner layer 216 in the first cycle depends on the toner adhesion amount per unit area on the transparent substrate 210. More specifically, the larger is the toner adhesion amount on the transparent substrate 210, the larger is the return peak value Vr capable of causing the toner particles in the recessed portions in the recording medium 214 to return to the toner layer 216.

As understood from these experiments, the secondary transfer bias consisting of the AC component and the CD component can attain a sufficient image density on the recessed portions of the recording medium 214. Although advantageous, it was also found that without proper control of the peak-to-peak voltage Vpp of the AC component of the secondary transfer bias in accordance with the transfer conditions, the image density at the recessed portions of the recording medium 214 was insufficient and hence the pattern of light and dark patches was generated at the recessed portions. The transfer conditions such as temperature, humidity, a thickness of the recording medium, a size (depth) of the recessed portions of the recording medium surface, an amount of toner adhered to the surface of the intermediate transfer belt per unit area affect transferability of toner transferred from the intermediate transfer belt to the recording medium in the secondary transfer nip.

Due to the following reasons, the peak-to-peak voltage Vpp of the AC component of the secondary transfer bias needs to be properly controlled in accordance with the transfer conditions. Referring back to FIG. 10, the secondary transfer bias includes the offset voltage Voff superimposed on the AC bias. More specifically, the AC bias swings equally between the positive side and the negative side from 0V. The offset voltage Voff includes a DC bias having positive polarity opposite the charge polarity of toner. When the secondary transfer bias has the positive polarity during one cycle of the AC component, the toner particles in the toner layer on the belt surface are moved toward the recording medium in the secondary transfer nip.

When the secondary transfer bias attains the transfer peak value Vt, the electric field intensity in the direction in which the toner particles are transferred from the belt surface to the recording medium (hereinafter referred to as a transfer direction) is at its maximum. At this time, without a relatively large electric field intensity, the toner particles cannot be transferred favorably from the belt surface to the recording medium. As a result, the image density is insufficient not only at the recessed portions of the surface of the recording medium, but also at the projecting portions. Thus, the electric field intensity in the transfer direction needs to be increased until a sufficient image density is obtained at least at the projecting portions on the recording medium surface. Thereafter, this value is referred to as a "required electric field intensity in the transfer direction".

By contrast, while the secondary transfer bias has negative polarity, the toner particles return from the recording medium to the belt surface. As the secondary transfer bias reaches the return peak value Vr, the electric field intensity in the direction in which the toner particles are returned from the recording medium to the intermediate transfer belt (hereinafter referred to as a return direction) is at its maximum. At this time, in order to return the toner particles having been transferred to the recessed portions of the recording medium to the toner layer, a sufficient electrostatic force capable of returning the toner particles in the recessed portion to the toner layer within a half cycle needs to be applied to the toner particles transferred to the recessed portions. Thus, the electric field intensity in the return direction needs to be increased at least until the electrostatic force causes the toner particles transferred to the recessed portions of the recording medium surface to return to the toner layer within the half cycle. Thereafter, this value is referred to as a "required electric field intensity in the return direction".

The electric field intensity in the transfer direction depends on the transfer peak value Vt, and the electric field intensity in the return direction depends on the return peak value Vr. Furthermore, the sum of the peak values Vt and Vr is equal to the peak-to-peak value Vpp of the AC component. Therefore, as for the peak-to-peak voltage Vpp, the electric field intensity in the transfer direction needs to be at the required electric field intensity in the transfer direction.

In the meantime, the electric field intensity in the return direction needs to be at the required electric field intensity in the return direction or greater (thereafter, this value is referred to as a "required peak-to-peak"). The required peak-to-peak depends on transfer conditions which affect transferability. For example, when the transfer conditions such as temperature and humidity change, in particular, when temperature and humidity drop, the electrical resistance of the secondary transfer roller to which the secondary transfer bias is applied increases. Consequently, the required peak-to-peak increases in a low-temperature, low-humidity environment as compared with a high-temperature, high-humidity environment. It is to be noted that the temperature and the humidity are detected by an information receiving device such as a temperature detector 51 and a humidity detector 52 shown in FIG. 17, for example.

The peak-to-peak voltage Vpp needs to be properly controlled in accordance with the transfer conditions, for example, the temperature, due to reasons described above. It is desirable that the peak-to-peak voltage Vpp be controlled depending on the humidity as well.

In order to reliably transfer a toner image from the belt surface to the recording medium, a proper amount of direct current needs to flow between the belt surface and the recording medium. The offset voltage Voff capable of allowing the proper amount of direct current to flow depends on the thickness of the recording medium and an absolute humidity. More specifically, the thicker the recording medium and/or the lower the absolute humidity, the higher the electrical resistance of the recording medium, hence hindering the direct current from flowing easily. With an increase in the thickness of the recording medium and/or decrease in the absolute humidity, the offset voltage Voff needs to be increased to prevent insufficient direct current flowing between the belt surface and the recording medium and hence insufficient image density.

In view of the above, as a comparative example, a transfer power source may include an AC bias output device and a DC bias output device. More specifically, the AC bias output device outputs the peak-to-peak voltage Vpp of the AC bias under constant voltage control while changing a target value thereof in accordance with the transfer conditions such as temperature. The DC bias output device outputs the DC bias under constant-current control. In this configuration, the peak-to-peak voltage Vpp of the AC bias is changed to a proper level in accordance with the transfer conditions while supplying the DC bias under constant current control to allow a constant amount of direct current to flow between the belt surface and the recording medium regardless of the electrical resistance of the recording medium. However, the image density at the recessed portions is not sufficient in the low-temperature, low humidity environment.

This is because insufficient image density is associated with reverse charging of toner due to electric discharge. More specifically, as described above, the required peak-to-peak in a low-temperature, low-humidity environment is greater than in a high-temperature, high-humidity environment. If the temperature and the humidity become low but the electrical resistance of the recording medium does not change, the rise in the electrical resistance of the secondary transfer roller is a mere cause of the increase in the required peak-to-peak. However, because the temperature and the humidity become low, the electrical resistance of the recording medium increases due to loss of moisture, thereby increasing the DC voltage (offset voltage Voff) output under constant current control.

In order to secure the required electric field intensity in the return direction even when the offset voltage Voff increases, the peak-to-peak voltage of the AC bias needs to be increased accordingly. Therefore, the cause of the increase in the required peak-to-peak when the temperature and the humidity become low includes an increase in the electrical resistance of the recording medium in addition to an increase in the electrical resistance of the secondary transfer roller. Depending on the level of the electrical resistance of the secondary transfer roller, the transfer peak value Vt gets too high when increasing the peak-to-peak voltage Vpp to the same level as the required peak-to-peak. As a result, electric discharge occurs in the recessed portions of the recording medium in the secondary nip, causing reverse charging of the toner in the recessed portions. As described above, such reverse charging causes toner voids in an image at the recessed portions on the surface of the recording medium, which appears as white spots (absence of toner) in an output image. Toner voids or absence of toner appears as white spots in an image and stand out. As a result, a pattern of light and dark patches in accordance with the surface conditions appears more visible.

The present inventors performed further observation. A test machine having the same configurations as the image forming apparatus shown in FIG. 1 was used for the following experiments. As the secondary transfer bias power source 39, a function generator FG300 manufactured by Yokogawa Meters & Instruments Corporation was used to generate waveforms of a superimposed voltage which was then amplified by TREK Model 10/40 High-Voltage Power Amplifier and output.

Experiment 1

Each parameter of the test machine was set as follows.

Process linear velocity V=282 mm/s;

Offset voltage Voff of the secondary transfer bias=−1000 V under constant voltage control;

Peak-to-peak voltage Vpp of the AC component of the secondary transfer bias=7 kV under constant voltage control;

Frequency f of the AC component=500 Hz.

As a recording medium, textured paper called "LEATHAC 66" (a trade name, manufactured by TOKUSHU PAPER MFG. CO., LTD.) having a ream weight of 175 kg (hereinafter referred to as a sheet A) and "LEATHAC 66" having a ream weight of 215 kg (hereinafter referred to as a sheet B) was used. A "ream weight" herein refers to a weight of 1000 sheets of paper having the size of 788 mm×1091 mm. The roughness of the surface of "LEATHAC 66" is greater than that of "SAZANAMI". The maximum depth of the recessed portions of the surface of LEATHAC 66 was approximately 100 μm. The tests were performed under laboratory atmospheric conditions at 23° C. and 50% RH.

Under the conditions described above, an entirely solid black image of A4 size was formed on the sheet A and the sheet B. A sufficient image density was obtained both at the smooth portions (no recesses) and the recessed portions on the sheet A. A smooth portion herein refers to a smooth portion or a projecting portion on the surface of the recording medium. By contrast, a sufficient image density was not obtained both at the smooth portions and the recessed portions on the sheet B. When using the sheet B having a higher electrical resistance than that of the sheet A, simply outputting the offset voltage Voff of the secondary transfer bias under constant voltage control did not enable a sufficient amount of direct current to flow through the secondary transfer nip. As a result, the image density at the smooth portions as well as the recessed portions of the sheet B was insufficient.

Experiment 2

In Experiment 2, the DC voltage of the secondary transfer bias was output from the secondary transfer bias power source 39 under constant current control. A target output value of an offset current Ioff representing a current value of the DC component of the secondary transfer bias was set to −47.5 μA. Other than the target output value of the offset current Ioff described above, an entirely solid black image of A4 size was formed on the sheet A and the sheet B under the same conditions as Experiment 1. The image density was sufficient both at the smooth portions and the recessed portions of the sheet A and the sheet B. A necessary amount of direct current flowed through the secondary transfer nip using the sheet A and the sheet B having a higher electrical resistance than that of the sheet A. Thus, the image density was sufficient both at the smooth portions and the recessed portions.

Experiment 3

Each parameter of the test machine was set as follows.

Process linear velocity V=176 mm/s;

Frequency f of the AC component=500 Hz;

Peak-to-peak voltage Vpp of the AC component of the secondary transfer bias: Varied under constant voltage control;

Offset current Ioff of the DC component of the secondary transfer bias: Varied under constant current control.

LEATHAC 66 175 kg (sheet A) was used as a recording medium. The tests were performed under laboratory atmospheric conditions at 10° C. and 15% RH. A solid blue image was formed by superimposing a halftone (HT) image of magenta and a halftone image of cyan one atop the other, and the solid blue image thus obtained was output onto the sheet A with different values of the peak-to-peak voltage Vpp and the DC component. Transferability of toner with respect to the recessed portions and the smooth portions of the surface of the recording medium, and toner voids were visually evaluated.

Transferability of toner relative to the smooth portions of the surface of the recording medium refers to an ability to transfer toner particles from the belt surface to the smooth portions of the surface of the recording medium. Transferability of toner relative to the smooth portions was evaluated in the following manner. When toner particles were favorably transferred to the smooth portions, thus obtaining a sufficient image density, it was graded as "GOOD". When the image density was not as sufficient was the one evaluated as "GOOD" but the amount of toner particles transferred to the smooth portions was sufficient enough to obtain an acceptable image density, the transferability was graded as "FAIR". When the amount of toner particles transferred to the smooth portions was below the acceptable level, the transferability was graded as "POOR".

Transferability of toner relative to the recessed portions of the surface of the recording medium refers to an ability to transfer toner particles from the belt surface to the recessed portions of the recording medium. Transferability of toner relative to the recessed portions was evaluated in the following manner. When toner particles were favorably transferred to the recessed portions, thus obtaining a sufficient image density, it was graded as "GOOD". When the image density was not as sufficient was the one evaluated as "GOOD" but the amount of toner particles transferred to the recessed portions was sufficient enough to obtain an acceptable image density, the transferability was graded as "FAIR". When the amount of toner particles transferred to the recessed portions was below the acceptable level, the transferability was graded as "POOR".

It is to be noted that the evaluation of the transferability of toner relative to the recessed portions does not include a transfer failure due to toner voids. Thus, the transferability of toner relative to the recessed portions was evaluated based on an image density of the recessed portions without toner voids.

As for the evaluation of the toner voids at the recessed portions, when toner voids were not present at all, it was evaluated as "GOOD". When some toner voids were present but were within an acceptable level, it was evaluated as "FAIR". When the presence of toner voids was beyond the acceptable level, it was evaluated as "POOR".

FIG. 22 is a table showing different conditions of the peak-to-peak voltage Vpp and the offset current Ioff in Experiment 3. It is to be noted that the AC bias having a sinusoidal waveform shown in FIG. 10 was used as the AC bias in Conditions 1 through 7. By contrast, in Condition 8, similar to Experiment 8, as will be described later, an AC bias having a square wave and a return time ratio of 40% was employed.

As understood from FIG. 22, in Condition 1, regardless of the peak-to-peak voltage Vpp, the output target value of the offset current Ioff was fixed to −40 μA. By contrast, in Conditions 2 through 8, as the peak-to-peak voltage Vpp increased, the target output value of the offset current Ioff was reduced.

The results of image evaluations under each condition are shown in the table in FIG. 23. In FIG. 23, when all three evaluation items, that is, the transferability of toner relative to the smooth portions of the recording medium, the transferability of toner relative to the recessed portions, and generation of toner voids, were evaluated as "GOOD", it was evaluated as "GOOD" in FIG. 23. In a case in which at least one of the items was not evaluated as "GOOD", the result was shown only for the item which was not evaluated as "GOOD" in FIG. 23. Although not shown, other items not shown were evaluated as "GOOD". For example, for the solid blue image under Condition 2 with Vpp=4 kV, the transferability of toner relative to the recessed portions was evaluated as "POOR", which is shown as "RECESS: POOR" in FIG. 23. Although not shown, the evaluations of other items, the transferability of toner relative to the smooth portions and generation of toner voids, were "GOOD". For the solid blue image under Condition 2 with Vpp=10 kV, the evaluation of the presence of toner voids was "FAIR" (TONER VOIDS: FAIR). Although not shown, the evaluations of both the transferability of toner relative to the recessed portions and the smooth portions were "GOOD".

FIGS. 24A and 24B show a table showing integrated results shown in FIGS. 22 and 23. It is to be noted in FIGS. 24A and 24B a diagonal strike-through line is drawn over the evaluation results with "POOR".

As shown in FIGS. 24A and 24B, reducing the offset current Ioff as the peak-to-peak voltage Vpp was increased showed better results than keeping the offset current Ioff at a constant level. Condition 8 shows the best result. However, under Condition 8, a favorable result may still be obtained with the peak-to-peak voltage Vpp of 4 kV without increasing the offset current Ioff to −40 μA. For example, similar to the case with the peak-to-peak voltage Vpp of 12 kV, a favorable result may still be obtained with the offset current Ioff of −24 μA. In other words, even when the peak-to-peak voltage Vpp is increased, the offset current Ioff is not reduced, but the offset current Ioff is set to −24 μA regardless of the peak-to-peak voltage Vpp. With this configuration, a favorable result similar to the result of Condition 8 may be obtained.

In view of the above, further experiments were performed with additional conditions 9 through 11 as shown in FIG. 25.

FIG. 25 is a table showing the results of the present experiments. In FIG. 25, when the peak-to-peak voltage Vpp was 4 kV, the image density of the solid blue image at the smooth portions (projecting portions) was insufficient unless the offset current Ioff was increased to −38 μA at least. Therefore, with the offset current Ioff being constant regardless of the level of the peak-to-peak voltage Vpp, the image density at the smooth portions of the recording medium was insufficient when the peak-to-peak voltage Vpp was increased to a relatively large value.

It is to be noted that in Condition 8 even when the offset current Ioff was reduced as the peak-to-peak voltage Vpp increases, the image density was sufficient at the smooth portions of the recording medium. This means that as the peak-to-peak voltage Vpp increases, the required electric field intensity in the transfer direction decreases. This is because as the peak-to-peak voltage Vpp increases, the toner particles separate from the surface of the intermediate transfer belt more easily. (Adhesion of the toner particles relative to the intermediate transfer belt is reduced.)

Figure 16:
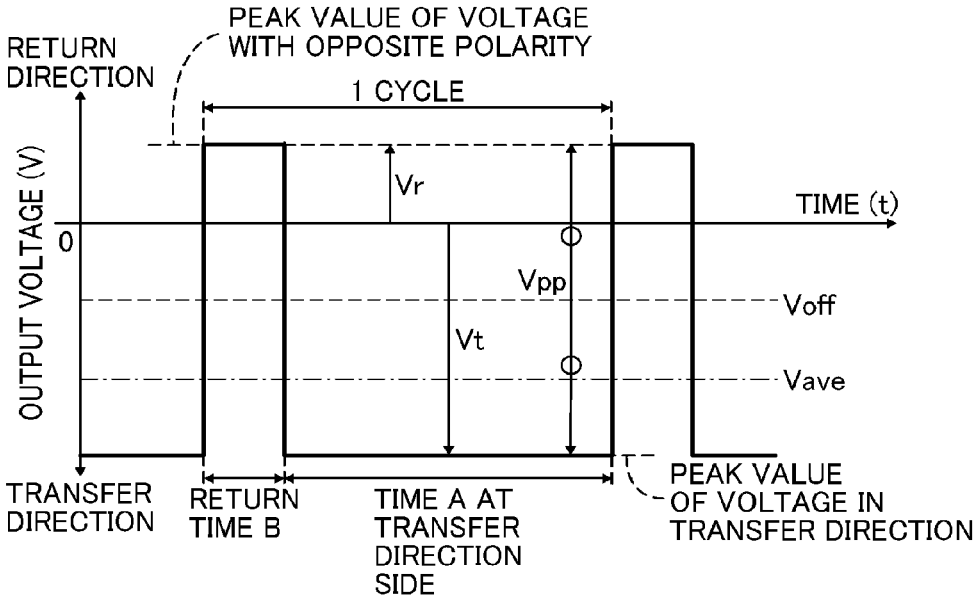
FIG. 16 is a waveform chart showing an example of a waveform of a secondary transfer bias including an alternating current (AC) component having a square wave.

In terms of potential conditions, Condition 8 was the same as Condition 5, but the waveform of the AC bias was different. More specifically, the AC bias of Condition 5 had a sinusoidal waveform such as shown in FIG. 10. By contrast, the AC bias of Condition 8 had a square wave with the return time ratio of 40% such as shown in FIG. 16. In view of the above, under the same potential conditions, the AC bias having a square wave and the return time ratio of less than 50% provides better results than the AC bias having a sinusoidal waveform. The return time ratio is explained later in Experiment 8.

Experiment 4

LEATHAC 66 has characteristics that as the ream weight increases, the thickness thereof increases and the depth of the recessed portions of the surface of the sheet increases. As a result, the distance between the toner particles transferred to the recessed portions and the surface of the belt increases at the secondary transfer nip N. Therefore, as the ream weight of the LEATHAC 66 increases, the required return peak value Vr for returning the toner particles transferred to the recessed portions to the belt surface increases.

Furthermore, it is desirable that the peak-to-peak voltage Vpp of the AC voltage be increased as the thickness of paper increases, in addition to increasing the peak-to-peak voltage Vpp in a low-temperature, low-humidity environment. More specifically, the peak-to-peak voltage Vpp of the AC voltage is increased to keep the surface potential of the secondary-transfer back surface roller 33 constant regardless of an increase in the electrical resistance of the secondary-transfer back surface roller 33 in a low-temperature, low-humidity environment. When the thickness of paper increases, the peak-to-peak voltage Vpp of the AC voltage is increased to accommodate an increase in the optimum value of the return peak value Vr due to an increase in the depth of the recessed portions of the recording medium.

The tests were performed under laboratory atmospheric conditions at 10° C. and 15% RH (low-temperature, low-humidity environment), using various ream weight of LEATHAC 66 to find an optimum peak-to-peak voltage Vpp and an offset current Ioff for each type. The results are shown in FIG. 26. FIG. 26 is a table showing the results of Experiment 4. In FIG. 26, in Condition 12, regardless of the peak-to-peak voltage Vpp, the target output value of the offset current Ioff was fixed to −40 μA. By contrast, in Conditions 13 through 16, as the peak-to-peak voltage Vpp was increased, the target output value of the offset current Ioff was reduced.

As understood from FIG. 26, when the peak-to-peak voltage Vpp was increased to prevent insufficient image density at the smooth portions as the thickness of the recording medium increased (from the ream weight 100 kg to 175 kg), a favorable image quality was achieved in the configuration in which as the peak-to-peak Vpp was increased, the offset current Ioff was reduced. More specifically, while maintaining the required electric field intensity in the transfer direction so as to attain a sufficient image density at the smooth portions and the recessed portions, the transfer peak value Vt was prevented from increasing, and generation of toner voids was suppressed.

Experiment 5

Print tests were performed under different laboratory atmospheric conditions such as temperature and humidity, and the fluctuation of the optimum peak-to-peak voltage Vpp in response to changes in the resistance of the secondary-transfer back surface roller 33 due to environmental changes was studied. As a recording medium, LEATHAC 66 175 kg (Sheet A) was used for all environmental conditions. The results are shown in FIG. 27.

FIG. 27 is a table showing the results of Experiment 5. In Condition 17 shown in FIG. 27, regardless of the peak-to-peak voltage Vpp, the target output value of the offset current Ioff was fixed to −38 μA. By contrast, in Conditions 18 through 21, as the peak-to-peak voltage Vpp was increased, the target output value of the offset current Ioff was reduced.

As understood from FIG. 27, even when the peak-to-peak voltage Vpp was increased to prevent insufficient image density at the smooth portions in a low-temperature, low-humidity environment (from 32° C., 80% to 10° C., 15%), a favorable image quality was maintained in the configuration in which as the peak-to-peak Vpp was increased, the offset current Ioff was reduced. More specifically, while maintaining the required electric field intensity in the transfer direction so as to attain a sufficient image density at the smooth portions and the recessed portions, the transfer peak value Vt was prevented from increasing, and generation of toner voids was suppressed.

Experiment 6

In Experiment 6, the present inventors studied a minimum threshold time during which the toner particles entered the recessed portions of the sheet surface were effectively returned to the belt surface in the secondary transfer nip N. The return time herein refers to a duration during which the secondary transfer bias including a superimposed voltage has the polarity in the return direction in one cycle of alternating current. The transfer time herein refers to a duration during which the secondary transfer bias including a superimposed voltage has the polarity in the transfer direction in one cycle of alternating current. The sum of the return time and the transfer time coincides with the value obtained in one cycle of the alternating current.

Figure 15:
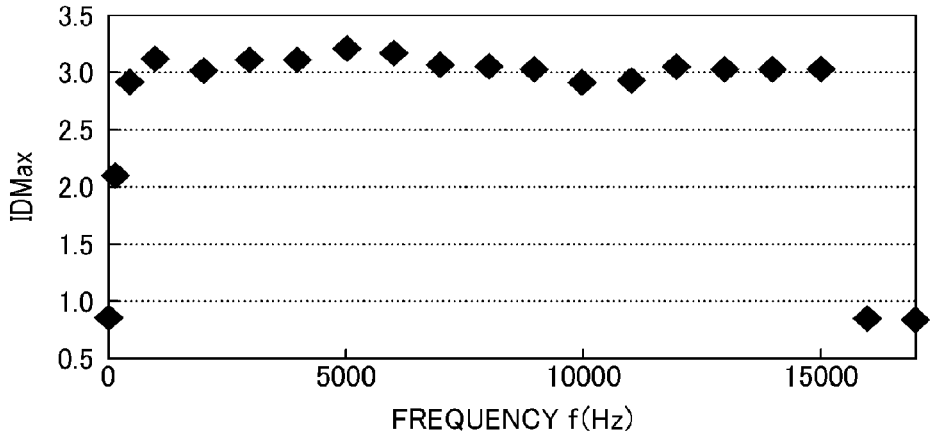
FIG. 15 is a graph showing a relation between an IDmax (maximum image density) of recessed portions on a surface of a recording medium and a frequency f of the AC component.

The return time ratio refers to a ratio of the return time in one cycle of the alternating current. The image density of the solid blue image at the recessed portions was measured under the return time ratio of 50% while changing the frequency f of the AC component of the secondary transfer bias. FIG. 15 shows a relation between an IDmax (maximum image density) of the recessed portions and the frequency f of the AC component in the experiment.

As understood from FIG. 15, when the frequency f of the AC component exceeded 16000 Hz, the IDmax at the recessed portions dropped sharply. This means that when one cycle of the alternating current drops below 0.06 msec, the IDmax of the recessed portions drops sharply. In this experiment, the return time ratio was 50%. Therefore, when the return time is below 0.03 msec, the IDmax at the recessed portions drops sharply.

Experiment 7

In this experiment, the peak-to-peak voltage Vpp of the AC component was 2500 V, the offset voltage Voff was −800 V, and the return time ratio was 20%. In Experiment 7, while changing the frequency f of the AC component and the process linear velocity v, the solid blue image was formed on a normal sheet of paper for each condition. The output solid blue images were visually evaluated. Unevenness of image density (e.g., pitch unevenness) caused possibly by an alternating electric field in the secondary transfer nip N was evaluated. Under the same frequency f, the faster the process linear velocity v, the more easily pitch unevenness occurred. Under the same process linear velocity v, the lower the frequency f, the more easily pitch unevenness occurred.

These results indicate that pitch unevenness occurs unless the toner moves back and forth between the intermediate transfer belt and the recessed portions of the surface of the recording medium for a number of times (N times) in the secondary transfer nip N. When the process linear velocity v was 282 mm/s and the frequency f was 400 Hz, no unevenness of image density was observed. However, when the process linear velocity v was 282 mm/s and the frequency f was 300 Hz, unevenness of image density was observed.

The width d of the secondary transfer nip N in the direction of movement of the belt was approximately 3 mm. The number N of back-and-forth movement of toner in the secondary transfer nip N in the condition under which no pitch unevenness was observed is calculated as approximately 4 times (3×400 Hz/282 mm/s), which is the minimum number of reciprocal movement of toner that does not cause pitch unevenness.

When the process linear velocity v was 141 mm/s and the frequency f was 200 Hz, no pitch unevenness was observed. However, when the process linear velocity v was 141 mm/s and the frequency f was 100 Hz, pitch unevenness was observed. Similar to the condition in which the process linear velocity v was 282 mm/s and the frequency f was 400 Hz, when the process linear velocity v was 141 mm/s and the frequency f was 200 Hz, the number N of back-and-forth movement of toner in the transfer nip N was calculated as approximately 4 times (3 mm×200 Hz/141 mm/sec). Therefore, when the following relation "frequency f>(4/d)*v" is satisfied, an image without unevenness of image density can be obtained.

Experiment 8

In Experiment 8, the AC component of the secondary transfer bias having a square wave such as shown in FIG. 16 was output from the secondary transfer bias power source 39. A duty cycle of the square wave of the AC component was not 50%, because the rise time toward the polarity in the return direction is shorter than the fall time toward the polarity in the transfer direction. Therefore, the return time ratio was less than 50%.

In FIG. 16, the DC component is superimposed on the AC component. Since the AC component has a square wave, the return time ratio is less than 50% even without superimposing the DC component. When using the AC component having a waveform having the return time ratio of less than 50% without the DC component, a sufficient image density was obtained both at the smooth portions and the recessed portions with the peak-to-peak voltage Vpp lower than when using the AC component having a waveform such as a sinusoidal waveform with the return time ratio of 50% without the DC component. This is because even when the electric field in the transfer direction is relatively weak, a sufficient amount of toner particles is transferred from the belt surface to the smooth portions of the recording medium with a relatively long fall time in the transfer direction. Therefore, using the AC component that provides the return time ratio less than 50% when using the AC component alone suppresses more reliably generation of toner voids than using the AC component having a waveform providing the return time ratio of 50%.

In Experiment 1 and Experiment 2, the AC component having a square wave as shown in FIG. 16 and the return time ratio of 40% is employed. In Experiment 3, the same AC component as described above is used only in Condition 8.

Experiment 9

In Experiment 9, fluctuation of the optimum value of the peak-to-peak voltage Vpp due to fluctuation of the amount of toner adhered to the intermediate transfer belt per unit area in the secondary transfer nip N was studied. A plurality of test images having different image areas was printed under different potential conditions. There is a correlation between an image area ratio of a toner image in the secondary transfer nip N and an amount of toner adhered to the intermediate transfer belt in the secondary transfer nip per unit area. Therefore, obtaining the image area ratio means obtaining the amount of toner adhered to the belt in the secondary transfer nip per unit area.

As a recording medium, LEATHAC 66 175 kg (Sheet A) was used. In the present experiment, the DC bias of the superimposed bias as the secondary transfer bias was not under constant current control. The DC bias was under constant voltage control so that the output voltage of the DC bias was constant. The image density of the smooth portions and the recessed portions, and toner voids in the test images having different image area ratios were visually evaluated. The potential conditions and the evaluation results of Experiment 9 are shown in the table in FIG. 28. In FIG. 28, Voff represents an offset voltage Voff serving as the DC bias.

In FIG. 28, Condition 22 had the same peak-to-peak voltage Vpp regardless of the image area ratios. In Condition 23, the peak-to-peak voltage Vpp was varied depending on the image area ratios. Based on the comparison between Conditions 22 and 23, it is understood that the necessary Vpp for transferring a sufficient amount of toner to the recessed portions of the recording medium increases as the image area ratio increases. However, in a case in which the image area ratio was relatively high, even when the peak-to-peak voltage Vpp was relatively high but the DC bias had the same level as that for a relatively low image area ratio such as in Condition 23, toner voids were generated due to electric discharge. In view of the above, while keeping the target output value of the peak-to-peak voltage high in accordance with an increase in the image area ratio, the target output value of the DC bias is reduced such as in Conditions 24 and 25. With this configuration, toner voids are prevented while obtaining a sufficient image density at the recessed portions of the surface of the recording medium.

The foregoing description pertains to reducing the target output value of the DC bias under constant voltage control as the image area ratio increases. Alternatively, the target output value of the DC bias under constant current control may be reduced. The target output value of the peak-to-peak voltage is set manually using an operation panel 50 (shown in FIG. 1) by users or automatically by the image forming apparatus in accordance with the image area ratio.

Figure 17:
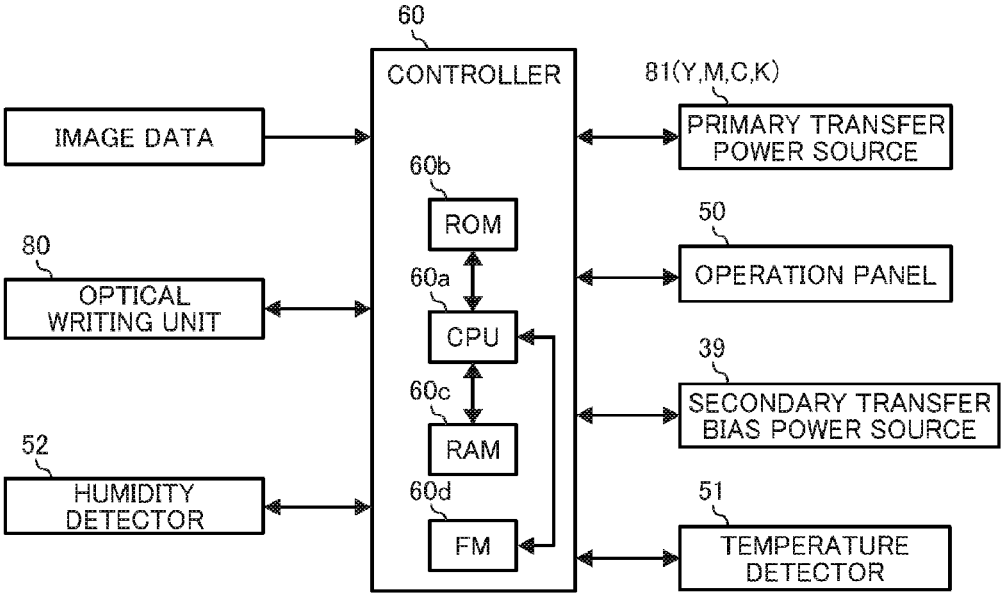
FIG. 17 is a block diagram illustrating a portion of an electrical circuit of the image forming apparatus according to an illustrative embodiment of the present disclosure.

With reference to FIG. 17, a description is provided of a characteristic configuration of the image forming apparatus according to the present illustrative embodiment of the present disclosure.

FIG. 17 is a block diagram illustrating a portion of an electrical circuit of the image forming apparatus according to an illustrative embodiment of the present disclosure. As illustrated in FIG. 17, the controller (processor) 60 includes a Central Processing Unit (CPU) 60*a* serving as an operation device, a Random Access Memory (RAM) 60*c* serving as a data memory, and a Read Only Memory (ROM) 60*b* serving as a temporary storage device, a flash memory (FM) 60*d*, and so forth. The controller 60 for controlling the entire image forming apparatus is connected to various devices and sensors. FIG. 17, however, illustrates only devices associated with the characteristic configurations of the image forming apparatus.

Primary transfer bias power sources 81Y, 81M, 81C, and 81K supply a primary transfer bias to the primary transfer rollers 35Y, 35M, 35C, and 35K. As described above, the secondary transfer bias power source 39 outputs the secondary transfer bias to be applied to the secondary-transfer back surface roller 33. An operation panel 50 serving as an information receiving device includes a touch panel and a plurality of key buttons. The operation panel 50 displays an image on the touch panel, and receives (obtains) an instruction input by users through the touch panel or the key buttons. Users can enter a type of paper or recording media placed in the sheet tray 100 through the operation panel 50. A type of paper or recording media includes, but is not limited to surface conditions thereof such as "SAZANAMI" and "LEATHAC 66", as well as a thickness, for example, 175 kg-sheet, i.e., Sheet A.

The secondary transfer bias power source 39 outputs the peak-to-peak voltage Vpp of the AC component of the secondary transfer bias under constant voltage control while supplying the offset current Ioff of the DC component under constant current control. The controller 60 controls the secondary transfer bias power source 39. It is to be noted that for the constant current control, the actual output value of the offset current Ioff is measured by an ammeter and the result thereof is subjected to a process through which the level of the DC voltage is adjusted (increased and decreased) to coincide with the target output value. The position at which the actual output value of the offset current Ioff is measured is inside the secondary transfer bias power source 39 in FIG. 1, upstream from an output terminal of the secondary transfer bias power source 39, for example.

Alternatively, the actual output value of the offset current Ioff is measured outside the secondary transfer bias power source 39 and near an electrode terminal contacting the metal cored bar of the secondary-transfer back surface roller 33.

The ROM 60*d* stores a data table showing relations between temperature and humidity, and a proper combination of the target output value of the peak-to-peak voltage Vpp and the target output value of the offset Ioff for each type of paper or recording media. In the data table, when it is a low-temperature, low-humidity environment and the combination of the temperature value and the humidity value is the same, the target output value of the peak-to-peak voltage Vpp is increased as the recording medium is of the type having higher electric resistance. While the target output value of the peak-to-peak voltage Vpp is increased, the target output value of the offset current Ioff is reduced.

According to the present illustrative embodiment, the target output value of the peak-to-peak voltage Vpp output under constant voltage control is changed in accordance with the transfer conditions such as temperature, humidity, an electric resistance of the recording medium, and so forth. Furthermore, the offset current Ioff is output under constant current control to control an amount of direct current flowing between the belt surface and the recording medium in the transfer nip. With this configuration, in a high-temperature, high-humidity environment in which the level of the peak-to-peak voltage Vpp of the AC bias does not have to be high, the peak-to-peak voltage Vpp can be low, but not too low so that electric discharge is not generated at the recessed portions of the recording medium in the secondary transfer nip.

Furthermore, the secondary transfer electric field is formed between the belt surface, and the smooth portions (projecting portions) and the recessed portions of the surface of the recording medium. With this configuration, the image density is sufficient both at the projecting portions and the recessed portions of the surface of the recording medium, thereby preventing a pattern of light and dark patches associated with the surface conditions of the recording medium.

By contrast, in a low-temperature, low-humidity environment in which the peak-to-peak voltage Vpp needs to be relatively high, as the peak-to-peak voltage Vpp is increased, the target output value of the offset current Ioff is reduced. With this configuration, the transfer peak value Vt is reduced and the return peak value Vr is increased. Accordingly, while the transfer peak value Vt is maintained at a level at which toner voids due to electric discharge are prevented, the return peak value Vr is maintained at a level at which the toner particles in the recessed portions of the surface of the recording medium are returned reliably to the surface of the image bearing surface.

Reducing the target output value of the offset current Ioff reduces the flow of direct current in the recording medium. Thus, although the image density of both recessed portions and the projecting portions of the recording medium surface is relatively low, toner voids and a lower image density at the recessed portions than at the projecting portions are prevented. Accordingly, a pattern of light and dark patches associated with the surface roughness or surface conditions of the recording medium is prevented.

As described above, according to the present illustrative embodiment, regardless of the environment, a pattern of light and dark patches according to the surface roughness of the recording medium is prevented. It is to be noted that while selecting a standard peak-to-peak voltage value that increases as the temperature and the humidity become low, a correction shift value that increases as the electric resistance of the recording medium increases is selected, and a sum of both values is set as the target output value of the peak-to-peak voltage. With this configuration, the peak-to-peak voltage is more optimized, as compared with setting the peak-to-peak voltage value based only on the environment conditions.

Instead of employing the AC bias under constant voltage control, the AC bias under constant current control may be employed. In this case, in accordance with a result provided by an information receiving device such as the temperature detector 51, the humidity detector 52, and the operation panel 50, the target output value of the current of the AC bias output from the transfer bias output device is changed such that the peak-to-peak voltage of the AC bias obtains the target value.

Although the relationship between the current and the voltage of the transfer bias changes due to resistance at the transfer portion, the following configuration can accommodate such a change in the resistance. For example, the relationship between the current and the voltage when the transfer condition, e.g., humidity changes from high humidity to low humidity, is obtained in advance through experiments or calculations. Then, the target output value of the current is changed such that the peak-to-peak voltage of the AC bias obtains the target value both in the high-humidity environment and the low-humidity environment.

In addition to changing the bias value in accordance with the humidity, the bias value may be changed in accordance with other transfer conditions. For example, as explained in Experiment 9, as the image area ratio, which is one of the transfer conditions, increases, (an absolute value of) the target output value of the peak-to-peak voltage is increased while reducing the (absolute value of) the target output value of the DC bias.

With reference to FIGS. 18 through 21, variations of the image forming apparatus are described below. The same reference numerals used in FIGS. 1 and 2 will be given to constituent elements such as parts and materials having the same functions, and the descriptions thereof will be omitted.

[Variation 1]

Figure 18:
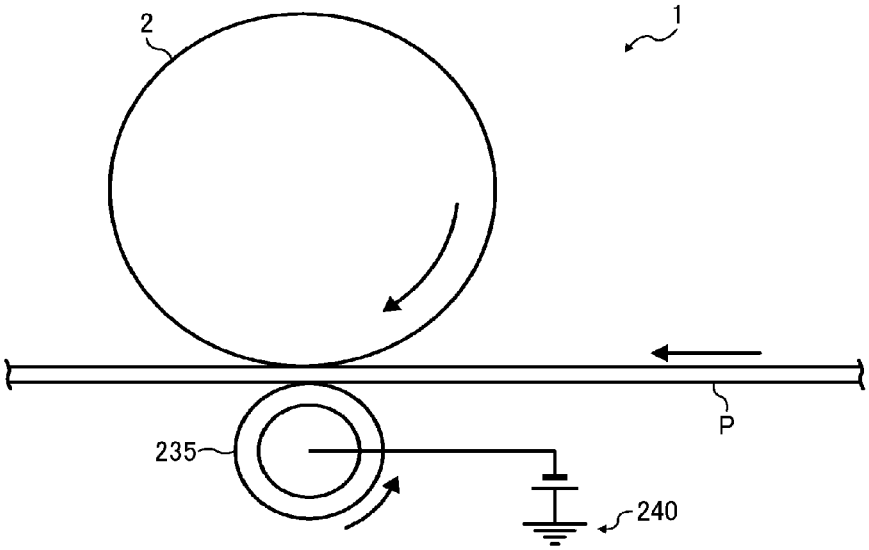
FIG. 18 is a schematic diagram illustrating a portion of an image forming unit employed in a first variation of the image forming apparatus.

With reference to FIG. 18, a description is provided of a first variation of the image forming apparatus. FIG. 18 is a schematic diagram illustrating a portion of the image forming unit 1 employed in the first variation of the image forming apparatus. As illustrated in FIG. 18, the image forming apparatus of the present variation includes one image forming unit 1 for forming a toner image of a single color. In FIG. 18, the image forming unit 1 includes the photosensitive drum 2 rotated by a driving device in the clockwise direction.

Although not illustrated, similar to the illustrative embodiment shown in FIG. 2, a cleaning device, a charge remover, a charging device, a developing device, and so forth are provided around the photosensitive drum 2. A transfer roller 235 serving as a nip forming member is disposed below the photosensitive drum 2. The transfer roller 235 is pressed against and contacts the photosensitive drum 2 by a biasing device, thereby forming a transfer nip therebetween. A recording medium P is sent to the transfer nip. The toner image on the photosensitive drum 2 is transferred onto the recording medium P in the transfer nip.

An example of the transfer roller 235 includes, but is not limited to, a roller, the circumferential surface of which is covered with a conductive foam layer, and a roller with a metal cored bar covered with a conductive elastic layer.

After the toner image is formed on the recording medium P as the recording medium P passes through the fixing nip, the recording medium P is delivered to a fixing device, and the toner image is fixed to the recording medium P. After the fixing process, in the case of double sided printing, the recording medium P is delivered to the fixing nip again by a duplex printing unit, thereby forming a toner image on the other side of the recording medium.

The secondary transfer roller 235 is supplied with a secondary transfer bias from a transfer bias power source 240. The secondary transfer bias power source 240 serves also as a potential difference generator. Similar to the secondary transfer bias power source 39 of the illustrative embodiment of the present disclosure, the transfer bias power source 240 includes a DC power source and an AC power source. Similar to the secondary transfer bias of the illustrative embodiment, in a high-temperature, high-humidity environment in which the level of the peak-to-peak voltage Vpp of the AC bias does not have to be high, the peak-to-peak voltage Vpp is low, but not too low so that electric discharge is not generated at the recessed portions of the recording medium in the secondary transfer nip, and an effective transfer electric field is formed between the surface of the photosensitive drum and the projections and recessed portions of the surface of the recording medium. With this configuration, the image density is sufficient both at the projecting portions and the recessed portions of the surface of the recording medium, thereby preventing a pattern of light and dark patches associated with the surface conditions of the recording medium.

By contrast, in a low-temperature, low-humidity environment in which the peak-to-peak voltage Vpp needs to be relatively high, the target output value of the offset current Ioff is reduced as the peak-to-peak voltage Vpp is increased. With this configuration, the transfer peak value Vt is reduced and the return peak value Vr is increased.

According to the present illustrative embodiment, toner having negative polarity is electrostatically repelled by the secondary-transfer back surface roller 33 to which the secondary transfer bias is applied, thereby transferring electrostatically the toner image from the secondary-transfer back surface roller 33 to the nip forming roller side. By contrast, according to Variation 1, the toner having negative polarity on the photosensitive drum 2 is electrostatically attracted to the transfer roller 235 to which the transfer bias is applied. Accordingly, the toner image is transferred electrostatically from the photosensitive drum 2 to the transfer roller side. Thus, the transfer bias power source 240 is configured to output the transfer bias having the same waveform as the one shown in FIG. 22.

[Variation 2]

Figure 19:
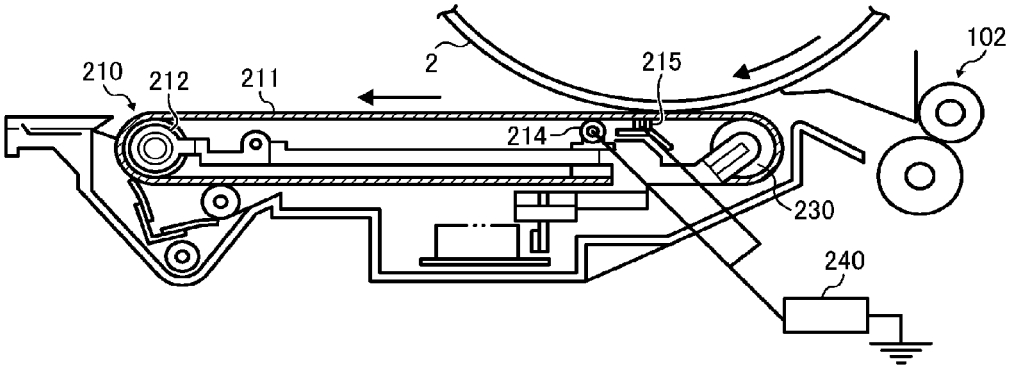
FIG. 19 is a schematic diagram illustrating a portion of an image forming unit employed in a second variation of the image forming apparatus.

With reference to FIG. 19, a description is provided of a second variation of the image forming apparatus. FIG. 19 is a schematic diagram illustrating a portion of the image forming unit 1 and a sheet conveyer unit 210 employed in the second variation of the image forming apparatus. As illustrated in FIG. 19, the image forming apparatus of the present variation includes one image forming unit 1 for forming a toner image of a single color. In FIG. 19, the image forming unit 1 includes the photosensitive drum 2 rotated by a driving device in the clockwise direction.

Although not illustrated, similar to the illustrative embodiment shown in FIG. 2, a drum cleaning device, a charge remover, a charging device, a developing device, and so forth are provided around the photosensitive drum 2. The sheet conveyer unit 210 is disposed substantially below the photosensitive drum 2.

As illustrated in FIG. 19, the sheet conveyer unit 210 includes a sheet conveyor belt 211, a drive roller 212, and a driven roller 230. The sheet conveyor belt 211 is formed into an endless loop and entrained around the drive roller 212 and the driven roller 213. The sheet conveyor belt 211 is rotated endlessly in the counterclockwise direction. The sheet conveyor belt 211 serving as the nip forming member contacts the photosensitive drum 2, thereby forming the transfer nip therebetween.

A transfer brush 215 and a transfer roller 214, both of which are disposed in the loop formed by the sheet conveyor belt 211, are disposed near the transfer nip and contact the rear surface of the sheet conveyor belt 211. The secondary transfer bias power source 240 serving as a potential difference generator applies a transfer bias to the transfer brush 215 and the secondary transfer roller 214.

The recording medium is fed to the transfer nip, at which the photosensitive drum 2 and the sheet conveyor belt 211 meet, by a pair of registration rollers 102. The toner image on the photosensitive drum 2 is transferred onto the recording medium in the transfer nip.

An example of the transfer roller 214 includes, but is not limited to, a roller, the circumferential surface of which is covered with a conductive foam layer, and a roller with a metal cored bar covered with a conductive elastic layer. An example of the transfer brush 215 includes a brush including a conductive support member on which a plurality of bristles made of conductive fiber is provided.

The recording medium P, on which the toner image is formed as the recording medium P passes through the fixing nip, is delivered to the fixing device, and the toner image is fixed to the recording medium. After the fixing process, in the case of double sided printing, the recording medium P is delivered to the fixing nip again by a duplex printing unit, thereby forming a toner image on the other side of the recording medium.

In FIG. 19, the transfer brush 215 contacts a portion of the sheet conveyor belt 211, at which the sheet conveyor belt 211 is interposed between the photosensitive drum 2 and the sheet conveyor belt 211 and downstream from the center of the transfer nip in the direction of movement of the sheet conveyor belt 211. Alternatively, the transfer brush 215 may contact the sheet conveyor belt 211 at the center of the transfer nip. The transfer brush 215 is disposed upstream from the transfer roller 214 in the direction of movement of the sheet conveyor belt 211. Alternatively, the transfer brush 215 is disposed downstream from the transfer roller 214 in the direction of movement of the sheet conveyor belt 211. Still alternatively, one of the transfer brush 215 and the transfer roller 214 may be disposed.

The transfer brush 215 and the transfer roller 214 are supplied with a secondary transfer bias from the secondary transfer bias power source 240. The secondary transfer bias power source 240 serves also as a potential difference generator. Similar to the secondary transfer bias power source 39 of the illustrative embodiment of the present disclosure, the transfer bias power source 240 includes the DC power source and the AC power source. The transfer bias power source 240 can output a DC bias consisting only of a DC voltage and a superimposed bias including an AC voltage superimposed on a DC voltage.

The transfer roller 214 is supplied with a transfer bias from the transfer bias power source 240. Similar to the secondary transfer bias of the image forming apparatus of Variation 1, in a high-temperature, high-humidity environment in which the level of the peak-to-peak voltage Vpp of the AC bias does not have to be high, the peak-to-peak voltage Vpp is low, but not too low so that electric discharge is not generated at the recessed portions of the recording medium in the secondary transfer nip, and an effective transfer electric field is formed between the surface of the photosensitive drum and the projections and recessed portions of the surface of the recording medium. With this configuration, a sufficient image density is attained both at the projecting portions and the recessed portions of the surface of the recording medium, thereby preventing a pattern of light and dark patches associated with the surface conditions of the recording medium.

By contrast, in a low-temperature, low-humidity environment in which the peak-to-peak voltage Vpp needs to be relatively high, the target output value of the offset current Ioff is reduced as the peak-to-peak voltage Vpp is increased. With this configuration, the transfer peak value Vt is reduced and the return peak value Vr is increased.

According to the image forming apparatus of the present variation, the toner having negative polarity on the photosensitive drum 2 is electrostatically attracted to the transfer roller 214 to which the transfer bias is applied. Accordingly, the toner image is transferred electrostatically from the photosensitive drum 2 toward the transfer roller 214. For this reason, the superimposed bias having the same waveform as that of the first variation (Variation 1) is used. The average absolute value per unit time of the superimposed bias is less than the absolute value of the DC bias consisting only of the DC voltage described above.

[Variation 3]

Figure 20:
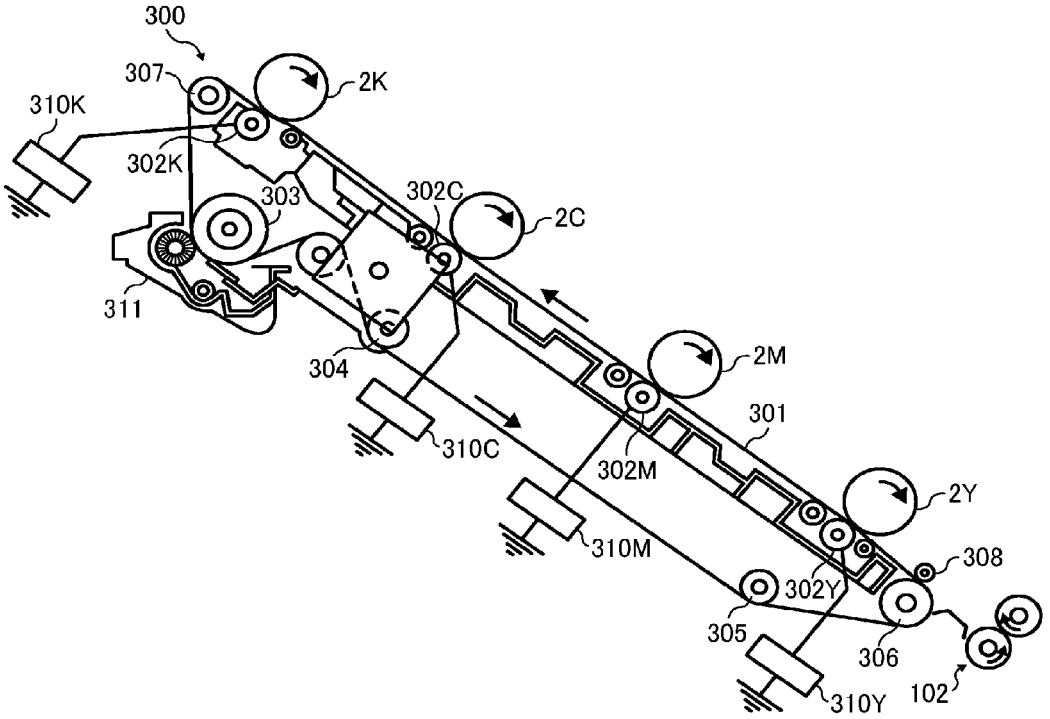
FIG. 20 is a schematic diagram illustrating a portion of image forming units and a transfer unit employed in a third variation of the image forming apparatus.

With reference to FIG. 20, a description is provided of a third variation of the image forming apparatus. FIG. 20 is a schematic diagram illustrating a portion of an image forming units and a transfer unit 300 employed in the third variation of the image forming apparatus. Similar to the illustrative embodiment shown in FIG. 2, a cleaning device, a charge remover, a charging device, a developing device, and so forth are provided around each of the photosensitive drums 2Y, 2M, 2C, and 2K.

A transfer unit 300 is disposed substantially below the photosensitive drums 2Y, 2M, 2C, and 2K. As illustrated in FIG. 20, the transfer unit 300 includes a transfer conveyor belt 301 formed into an endless loop and entrained around a plurality of rollers: four transfer rollers 302Y, 302M, 302C, and 302K, a separation roller 307, a drive roller 303, a first driven roller 304, a second driven roller 305, an entrance roller 306, and so forth. The transfer conveyor belt 301 is rotated endlessly in the counterclockwise direction by the drive roller 303.

The transfer conveyor belt 301 is interposed between the photosensitive drums 2Y, 2M, 2C, and 2K, and the transfer rollers 302Y, 302M, 302C, and 302K. The outer peripheral surface or the image bearing surface of the transfer conveyor belt 301 serving as the nip forming member contacts the photosensitive drums 2Y, 2M, 2C, and 2K, thereby forming the transfer nips for the colors yellow, magenta, cyan, and black therebetween.

A sheet suction roller 308 is disposed outside the looped transfer conveyor belt 301 and contacts the transfer conveyor belt 301 entrained around the entrance roller 306, thereby forming a sheet suction nip therebetween. A belt cleaning device 311 contacts the transfer conveyor belt 301 entrained around the drive roller 303, thereby forming a cleaning nip therebetween.

An example of the transfer rollers 302Y, 302M, 302C, and 302K includes, but is not limited to, a roller, the circumferential surface of which is covered with a conductive foam layer, and a roller with a metal cored bar covered with a conductive elastic layer. The transfer rollers 302Y, 302M, 302C, and 302K are supplied with a transfer bias from transfer bias power sources 310Y, 310M, 310C, and 310K. With this configuration, a transfer electric field that electrostatically transfers toner from the photosensitive drum side to transfer roller side is formed between each of the transfer rollers 302Y, 302M, 302C, and 302K, and the electrostatic latent images on the photosensitive drums 2Y, 2M, 2C, and 2K.

The sheet suction roller 308 is supplied with a sheet suction bias from a sheet suction bias power source. The pair of the registration rollers 102 is disposed substantially near the sheet suction roller 308 and feeds the recording medium to the sheet suction nip at a predetermined timing. The recording medium in the sheet suction nip between the sheet suction roller 308 and the transfer conveyor belt 301 is attracted to the outer peripheral surface of the transfer conveyor belt 301 by the electrostatic force. The sheet conveyor belt 301 rotates while carrying the recording medium on the surface thereof and passes through each transfer nip. The toner images of yellow, magenta, cyan, and black are transferred onto the recording medium such that they are superimposed one atop the other, thereby forming a composite toner image.

The recording medium passing through the last transfer nip in the transfer process, that is, the transfer nip for the color black, is delivered to the position opposite the separation roller 307 as the transfer conveyor belt 301 moves. At this position, the transfer conveyor belt 301 is wound at a relatively large winding angle around the separation roller 307. Consequently, the direction of movement changes suddenly. As a result, the recording medium electrostatically adhered to the surface of the transfer conveyor belt 301 cannot follow the sudden change in the direction of movement, thereby separating or self-stripping from the surface of the belt.

The recording medium separated from the transfer conveyor belt 301 in such a manner is delivered to the fixing device in which the composite toner image is fixed onto the recording medium. After the fixing process, in the case of double sided printing, the recording medium is delivered to the pair of the registration rollers 102 by the duplex printing unit, thereby forming a toner image on the other side of the recording medium.

The transfer bias power sources 310Y, 310M, 310C, and 310K serve also as potential difference generators. Similar to the secondary transfer bias power source 39 of the illustrative embodiment of the present disclosure, the transfer bias power sources 310Y, 310M, 310C, and 310K include the DC power source and the AC power source. The transfer bias power sources 310Y, 310M, 310C, and 310K can output a DC bias consisting only of a DC voltage, and a superimposed bias including an AC voltage superimposed on a DC voltage.

Similar to the secondary transfer bias power source 39 of the illustrative embodiment of the present disclosure, the transfer bias power sources 310Y, 310M, 310C, and 310K include the DC power source and the AC power source.

Similar to the secondary transfer bias of the illustrative embodiment, in a high-temperature, high-humidity environment in which the level of the peak-to-peak voltage Vpp of the AC bias does not have to be high, the peak-to-peak voltage Vpp is low, but not too low so that electric discharge is not generated at the recessed portions of the recording medium in the secondary transfer nip, and an effective transfer electric field is formed between the surface of the photosensitive drum and the projections and recessed portions of the surface of the recording medium. With this configuration, the image density is sufficient both at the projecting portions and the recessed portions of the surface of the recording medium, thereby preventing a pattern of light and dark patches associated with the surface conditions of the recording medium.

By contrast, in a low-temperature, low-humidity environment in which the peak-to-peak voltage Vpp needs to be relatively high, the target output value of the offset current Ioff is reduced as the peak-to-peak voltage Vpp is increased. Accordingly, the transfer peak value Vt is reduced, and the return peak value Vr is increased.

According to the image forming apparatus of the present variation, the toner having negative polarity on the photosensitive drums 2Y, 2M, 2C, and 2K is electrostatically attracted to the transfer rollers 302Y, 302M, 302C, and 302K to which the transfer bias is applied. Accordingly, the toner images are transferred electrostatically from the photosensitive drums 2Y, 2M, 2C, and 2K toward the transfer rollers 302Y, 302M, 302C, and 302K. For this reason, the superimposed bias having the same waveform as that of the first variation (Variation 1) is employed. The average absolute value per unit time of the superimposed bias is less than the absolute value of the DC bias consisting only of the DC voltage described above.

[Variation 4]

Figure 21:
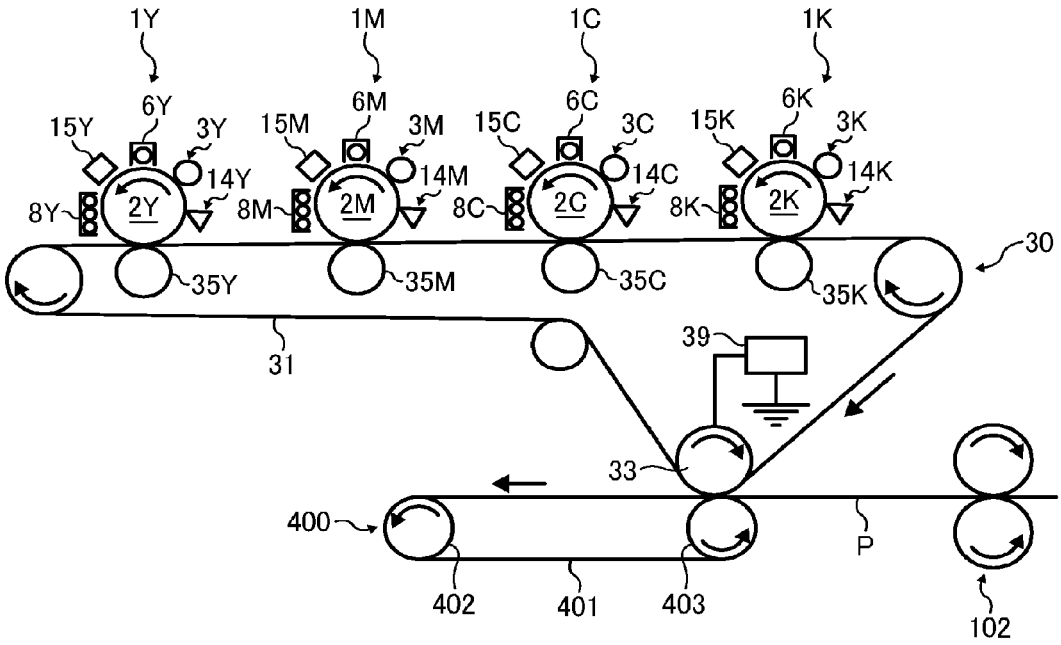
FIG. 21 is a schematic diagram illustrating a fourth variation of the image forming apparatus.

With reference to FIG. 21, a description is provided of a fourth variation of the image forming apparatus. FIG. 21 is a schematic diagram illustrating a main section of the fourth variation of the image forming apparatus. In FIG. 21, the image forming units 1Y, 1M, 1C, and 1K include charge erasing lamps 14Y, 14M, 14C, and 14K, the charging devices 6Y, 6M, 6C, and 6K, the developing devices 8Y, 8M, 8C, and 8K, latent image writing devices 15Y, 15M, 15C, and 15K, and so forth, respectively. The image forming unit 1Y, 1M, 1C, and 1K all have the same configurations as all the others, deferring only in the color of toner employed. Thus, the description is provided of the image forming unit 1K as a representative example of the image forming units 1. The latent image writing device 15K writes optically an electrostatic latent image on the surface of the photosensitive drum 2K.

The intermediate transfer belt 31 of the transfer unit 30 moves in the clockwise direction and passes through the primary transfer nips of yellow, magenta, cyan, and black, accordingly. Thus, a composite toner image in which the toner images of yellow, magenta, cyan, and black are superimposed one atop the other is formed on the outer peripheral surface of the intermediate transfer belt 31.

A sheet conveyer unit 400 is disposed substantially below the transfer unit 30 to move a sheet conveyor belt 401 formed into a loop. As illustrated in FIG. 21, the sheet conveyer unit 400 includes the sheet conveyor belt 401, a drive roller 402, and a secondary transfer pressing roller 403. The sheet conveyor belt 401 is formed into an endless loop and entrained around the drive roller 402 and the secondary transfer pressing roller 403. The sheet conveyor belt 401 is rotated endlessly in the counterclockwise direction by rotation of the drive roller 402.

In the sheet conveyor unit 400, a portion of the sheet conveyor belt 401 entrained around the secondary transfer pressing roller 403 in the circumferential direction contacts the intermediate transfer belt 31 wound around the secondary-transfer back surface roller 33. Accordingly, the outer peripheral surface or the image bearing surface of the intermediate transfer belt 31 contacts the outer peripheral surface of the sheet conveyor belt 401 serving as the nip forming member, thereby forming a secondary transfer nip therebetween.

A secondary transfer bias is applied to the secondary-transfer back surface roller 33 by the secondary transfer bias power source 39 of the illustrative embodiment. The secondary transfer pressing roller 403 of the sheet conveyor unit 400 is grounded. Near and in the secondary transfer nip, a secondary transfer electric field is formed between the secondary-transfer back surface roller 33 and the secondary transfer pressing roller 403.

The recording medium is sent to the secondary transfer nip by the pair of registration rollers 102. Subsequently, in the secondary transfer nip, the composite toner image on the intermediate transfer belt 31 is transferred secondarily onto the recording medium. The recording medium passes through the secondary transfer nip as the sheet conveyor belt 401 moves while the recording medium is electrostatically adhered to the outer peripheral surface of the sheet conveyor belt 401. Then, the recording medium comes to the position opposite the drive roller 402 disposed inside the loop of the sheet conveyor belt 401. At this position, the sheet conveyor belt 401 is wound at a relatively large angle around the drive roller 402, thereby changing the direction of movement suddenly.

As a result, the recording medium electrostatically adhered to the surface of the sheet conveyor belt 401 cannot follow the sudden change in the direction of movement, thereby separating or self-stripping from the surface of the belt.

The recording medium separated from the sheet conveyor belt 401 in such a manner is delivered to the fixing device in which the composite toner image is fixed onto the recording medium. After the fixing process, in the case of double sided printing, the recording medium is delivered to the pair of registration rollers 102 by the duplex printing unit, thereby forming a toner image on the other side of the recording medium.

Similar to the secondary transfer bias power source 39 of the illustrative embodiment of the present disclosure, the transfer bias power source 39 of the image forming apparatus of the present variation includes the DC power source and the AC power source.

In a high-temperature, high-humidity environment in which the level of the peak-to-peak voltage Vpp of the AC bias does not have to be high, the peak-to-peak voltage Vpp is low, but not too low so that electric discharge is not generated at the recessed portions of the recording medium in the transfer nip, and in the meantime an effective transfer electric field is formed between the belt surface and the projections and recessed portions of the surface of the recording medium. With this configuration, a sufficient image density is attained both at the projecting portions and the recessed portions of the surface of the recording medium, thereby preventing a pattern of light and dark patches associated with the surface conditions of the recording medium.

By contrast, in a low-temperature, low-humidity environment in which the peak-to-peak voltage Vpp needs to be relatively high, as the peak-to-peak voltage Vpp is increased, the target output value of the offset current Ioff is reduced. Accordingly, the transfer peak value Vt is reduced while increasing the return peak value Vr.

It is to be noted that the secondary-transfer back surface roller 33 may be grounded while the secondary transfer bias is applied to the secondary transfer pressing roller 403.

The above-described image forming apparatus is an example of the image forming apparatus of the present invention. The present invention includes the following embodiments. According to an aspect of this disclosure, an image forming apparatus includes an image bearing member (e.g., the intermediate transfer belt 31) to bear a toner image on a surface thereof; a nip forming member (e.g., the nip forming roller 36) to contact the surface of the image bearing member to form a transfer nip therebetween; a transfer bias output device (e.g., the secondary transfer bias power source 39) to output a transfer bias to form a transfer electric field including an alternating electric field in the transfer nip to transfer the toner image from the image bearing member onto a recording medium interposed in the transfer nip, the transfer bias including a superimposed bias in which an alternating current (AC) bias is superimposed on a direct current (DC) bias; an information receiving device (e.g., the operation panel 50, the temperature detector, and the humidity detector 52) to receive information that affects transfer of the toner image from the image bearing member to the recording medium in the transfer nip; and a controller (e.g., the controller 60) operatively connected to the information receiving device and the transfer bias output device, to cause the transfer bias output device to change a target output value of a peak-to-peak voltage of the AC bias based on the information received by the information receiving device such that a target output value of the DC bias decreases as the target output value of the peak-to-peak voltage of the AC bias increases.

According to an aspect of this disclosure, the controller (e.g., the controller 60) controls the transfer bias output device (the secondary transfer bias power source 39) to output the DC bias under constant current control such that the target output value of the DC bias under constant current control decreases as the target output value of the peak-to-peak voltage increases. By supplying the DC bias under constant current control, a certain level of the DC current flows in the recording medium even when the electrical resistance thereof changes.

According to an aspect of this disclosure, the controller controls the transfer bias output device to output the DC bias under constant voltage control such that the target output value of the DC bias under constant voltage control decreases as the target output value of the peak-to-peak voltage increases.

According to an aspect of this disclosure, the information received by the information receiving device includes temperature, and the controller controls the transfer bias output device to increase the target output value of the peak-to-peak voltage as the temperature received by the information receiving device decreases. With this configuration, even when the electrical resistance of a device, for example, the secondary-transfer back surface roller 33, to which a secondary transfer bias is applied, increases as the temperature decreases, a sufficient alternating electric field is formed in the transfer nip.

According to an aspect of this disclosure, the information received by the information receiving device includes humidity, and the controller controls the transfer bias output device to increase the target output value of the peak-to-peak voltage as the humidity received by the information receiving device decreases. With this configuration, even when the electrical resistance of a device, for example, the secondary-transfer back surface roller 33, to which a secondary transfer bias is applied, increases as the humidity decreases, a sufficient alternating electric field is formed in the transfer nip.

According to an aspect of this disclosure, the information received by the information receiving device includes a thickness of the recording medium delivered to the transfer nip, and the controller controls the transfer bias output device to increase the target output value of the peak-to-peak voltage as the thickness obtained by the information receiving device increases. With this configuration, even when the electrical resistance of the recording medium increases due to an increase in the thickness thereof, a sufficient alternating electric field is formed in the transfer nip.

According to an aspect of this disclosure, the information received by the information receiving device includes a surface condition including a depth of a recessed portion of the recording medium delivered to the transfer nip, and the controller controls the transfer bias output device to increase the target output value of the peak-to-peak voltage as the depth of the recessed portion of the surface of the recording medium obtained by the information receiving device increases. With this configuration, even when an optimum value of the return peak Vr increases due to an increase in the depth of the recessed portion of the surface of the recording medium, a sufficient alternating electric field is formed in the transfer nip.

According to an aspect of this disclosure, the information received by the information receiving device includes an amount of toner adhered to the surface of the image bearing member per unit area, and the controller controls the transfer bias output device to increase the target output value of the peak-to-peak voltage as the amount of toner adhered to the surface of the image bearing member obtained by the information receiving device increases. With this configuration, even when an optimum value of the transfer peak value Vt increases due to an increase in the amount of the adhered toner, a sufficient alternating electric field is formed in the transfer nip.

According to an aspect of this disclosure, the controller controls the transfer bias output device to output the AC bias under constant voltage control.

According to an aspect of this disclosure, the controller controls the transfer bias output device to output the transfer bias such that a time-averaged potential of the superimposed bias in one cycle is shifted from a center value between a maximum potential and a minimum potential in one cycle toward a value at which the toner is transferred more easily from the image bearing member to the recording medium in the transfer nip. With this configuration, the return time ratio of the AC component alone is below 50% which reduces a level of an optimum peak-to-peak voltage Vpp, thus preventing toner voids, as compared with the return time ratio of 50%.

According to an aspect of this disclosure, the superimposed bias output as the transfer bias by the transfer bias output device has alternately a positive polarity and a negative polarity for a certain duration in one cycle, and the duration of the positive polarity or the second polarity, whichever causes the toner to return from the recording medium to the image bearing member, is equal to or greater than 0.03 milliseconds (msec). With this configuration, the toner particles having been transferred to the recessed portions of the recording medium are returned effectively to the belt surface, thereby preventing insufficient image density at the recessed portions.

According to an aspect of this disclosure, the following relation is satisfied: $f>(4/d)\times v$, where f is a frequency (Hz) of the AC bias, d is a width (mm) of the transfer nip in a direction of rotation of the image bearing member, and v is a speed of rotation (mm/s) of the image bearing member. With this configuration, as described above, a periodical unevenness of image density caused by insufficient back-and-forth movement of toner between the recording medium and the image bearing member in the transfer nip is prevented.

According to an aspect of this disclosure, an image forming apparatus, comprising includes an image bearing member to bear a toner image on a surface thereof, a nip forming member to contact the surface of the image bearing member to form a transfer nip therebetween; a transfer bias output device to output a transfer bias to form a transfer electric field including an alternating electric field in the transfer nip to transfer the toner image from the image bearing member onto a recording medium interposed in the transfer nip, the transfer bias including a superimposed bias in which an alternating current (AC) bias is superimposed on a direct current (DC) bias; an information receiving device to receive information including at least one of temperature, humidity, a thickness of the recording medium delivered to the transfer nip, a surface condition of the recording medium including a depth of a recessed portion thereof, and an amount of toner adhered to the surface of the image bearing member per unit area; and a controller operatively connected to the information receiving device and the transfer bias output device, to cause the transfer bias output device to change a target output value of a peak-to-peak voltage of the AC bias based on the information received by the information receiving device such that a target output value of the DC bias decreases as the target output value of the peak-to-peak voltage of the AC bias increases.

According to an aspect of this disclosure, the controller controls the transfer bias output device to output the DC bias under constant current control such that the target output value of the DC bias under constant current control decreases as the target output value of the peak-to-peak voltage increases.

According to an aspect of this disclosure, the controller controls the transfer bias output device to output the AC bias under constant voltage control.

According to an aspect of this disclosure, the above-described embodiments are employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a toner image on a surface thereof;

a nip forming member to contact the surface of the image bearing member to form a transfer nip therebetween;

a power source to output a superimposed bias in which an alternating current (AC) bias is superimposed on a direct current (DC) bias, to the transfer nip to transfer the toner image from the image bearing member onto a recording medium interposed in the transfer nip;

an information receiving device to receive information about a thickness of the recording medium delivered to the transfer nip; and a controller to control the power source, wherein the power source outputs a first superimposed bias to the transfer nip when the thickness of the recording medium is a first thickness and outputs a second superimposed bias to the transfer nip when the thickness of the recording medium is a second thickness that is greater than the first thickness, a peak-to-peak voltage of the AC bias of the second superimposed bias is greater than the peak-to-peak voltage of the AC bias of the first superimposed bias, and an absolute value of the DC bias of the second superimposed bias is less than the absolute value of the DC bias of the first superimposed bias.

2. The image forming apparatus according to claim 1, wherein the information receiving device includes an operation panel.

3. The image forming apparatus according to claim 1, wherein the controller controls the DC bias of the power source under constant current control.

4. The image forming apparatus according to claim 1, wherein the controller controls the DC bias of the power source under constant voltage control.

5. The image forming apparatus according to claim 1, wherein the controller controls the AC bias of the power source under constant voltage control.

6. An image forming apparatus, comprising:

an image bearing member to bear a toner image on a surface thereof;

a nip forming member to contact the surface of the image bearing member to form a transfer nip therebetween;

a power source to output a superimposed bis in which an alternating current (AC) bias is superimposed on a direct current (DC) bias, to the transfer nip to transfer the toner image from the image bearing member onto a recording medium interposed in the transfer nip;

an information receiving device to receive information about a depth of a recessed portion of the recording medium delivered to the transfer nip; and a controller to control the power source, wherein the power source outputs a first superimposed bias to the transfer nip when the depth of the recessed portion of the recording medium is a first depth and outputs a second superimposed bias to the transfer nip when the depth of the recessed portion of the recording medium is a second depth that is greater than the first depth, a peak-to-peak voltage of the AC bias of the second superimposed bias is greater than the peak-to-peak voltage of the AC bias of the first superimposed bias, and an absolute value of the DC bias of the second superimposed bias is less than the absolute value of the DC bias of the first superimposed bias.

7. The image forming apparatus according to claim 6, wherein the information receiving device includes an operation panel.

8. The image forming apparatus according to claim 6, wherein the controller controls the DC bias of the power source under constant current control.

9. The image forming apparatus according to claim 6, wherein the controller controls the DC bias of the power source under constant voltage control.

10. The image forming apparatus according to claim 6, wherein the controller controls the AC bias of the power source under constant voltage control.

11. An image forming apparatus, comprising:

an image bearing member to bear a toner image on a surface thereof;

a nip forming member to contact the surface of the image bearing member to form a transfer nip therebetween;

a power source to output a superimposed bias in which an alternating current (AC) bias is superimposed on a direct current (DC) bias, to the transfer nip to transfer the toner image from the image bearing member onto a recording medium interposed in the transfer nip;

an information receiving device to receive information about an amount of toner adhered to the surface of the image bearing member per unit area; and a controller to control the power source, wherein the power source outputs a first superimposed bias to the transfer nip when the amount of toner is a first amount and outputs a second superimposed bias to the transfer nip when the amount of toner is a second amount that is greater than the first amount, a peak-to-peak voltage of the AC bias of the second superimposed bias is greater than the peak-to-peak voltage of the AC bias of the first superimposed bias, and an absolute value of the DC bias of the second superimposed bias is less than the absolute value of the DC bias of the first superimposed bias.

12. The image forming apparatus according to claim 11, wherein the controller controls the DC bias of the power source under constant current control.

13. The image forming apparatus according to claim 11, wherein the controller controls the DC bias of the power source under constant voltage control.

14. The image forming apparatus according to claim 11, wherein the controller controls the AC bias of the power source under constant voltage control.

* * * * *